US006751964B2

(12) United States Patent
Fischer

(10) Patent No.: US 6,751,964 B2
(45) Date of Patent: Jun. 22, 2004

(54) DESICCANT-BASED DEHUMIDIFICATION SYSTEM AND METHOD

(76) Inventor: John C. Fischer, 737 Terrell Crossing, Marietta, GA (US) 30067

( * ) Notice: Subject to any disclaimer, the term of this patent is extended or adjusted under 35 U.S.C. 154(b) by 0 days.

(21) Appl. No.: 10/184,249

(22) Filed: Jun. 28, 2002

(65) Prior Publication Data

US 2004/0000152 A1 Jan. 1, 2004

(51) Int. Cl.[7] ..... F25D 17/06
(52) U.S. Cl. ..... 62/94; 62/271; 62/332
(58) Field of Search ..... 62/314, 315, 312, 62/94, 271, 332

(56) References Cited

U.S. PATENT DOCUMENTS

| | | | | |
|---|---|---|---|---|
| 3,009,684 A | | 11/1961 | Munters | 257/267 |
| 3,144,901 A | | 8/1964 | Meek | 165/6 |
| 3,844,737 A | * | 10/1974 | Macriss et al. | 55/34 |
| 3,914,955 A | * | 10/1975 | McCullough | 62/237 |
| 4,484,938 A | | 11/1984 | Okamoto et al. | 55/269 |
| 4,582,129 A | | 4/1986 | Yano et al. | 165/97 |
| 4,594,860 A | | 6/1986 | Coellner et al. | 62/271 |
| 4,723,417 A | | 2/1988 | Meckler | 62/271 |
| 4,769,053 A | | 9/1988 | Fischer, Jr. | 55/389 |
| 4,955,205 A | | 9/1990 | Wilkinson | 62/94 |
| 5,170,633 A | | 12/1992 | Kaplan | 62/94 |
| 5,176,005 A | | 1/1993 | Kaplan | 62/94 |
| 5,300,138 A | | 4/1994 | Fischer, Jr. | 96/125 |
| 5,373,704 A | | 12/1994 | McFadden | 62/94 |
| 5,401,706 A | | 3/1995 | Fischer, Jr. | 502/401 |
| 5,448,895 A | | 9/1995 | Coellner et al. | 62/94 |
| 5,496,397 A | | 3/1996 | Fischer et al. | 96/154 |
| 5,502,975 A | | 4/1996 | Brickley et al. | 62/94 |
| 5,517,828 A | | 5/1996 | Calton | 62/271 |
| 5,526,651 A | | 6/1996 | Worek et al. | 62/271 |

FOREIGN PATENT DOCUMENTS

GB 1 551 647 8/1979

OTHER PUBLICATIONS

1999, Semco Incorporated, SEMCO Incorporated Desiccant Wheel Products; Pinnacle Primary Ventilation System Technical Guide.
Apr. 1997, Steven A. Parker, Two–Wheel Desiccant Dehumidification System (Abstract), Federal Technology Alerts.
Apr. 1996, James C. Smith, Schools Resolve IAQ/Humidity Problems with Desiccant Preconditioning, Heating/Piping/Air Conditioning.
Jun. 1997, James F. Swails, Leon M. Hobbs, III, and Douglas A. Neal, A Cure for Growing Pains, Consulting/Specifying Engineer.
Sep. 1995, Robert DiBlasio, Desiccants In Hospitals—Conditioning A Research Facility, Engineered Systems.
1996, Chris Downing, Humidity Control—No Place Like Home, Engineered Systems.

(List continued on next page.)

*Primary Examiner*—Melvin Jones
(74) *Attorney, Agent, or Firm*—Christopher J. Hayes; Bryan Cave LLP

(57) ABSTRACT

The present invention provides an apparatus for dehumidifying air supplied to an enclosed space by an air conditioning unit. The apparatus includes a partition separating the interior of the housing into a supply portion and a regeneration portion. The supply portion has an inlet for receiving supply air from the air conditioning unit and an outlet for supplying air to the enclosed space. A regeneration fan creates the regeneration air stream. The apparatus includes an active desiccant wheel positioned such that a portion of the wheel extends into the supply portion and a portion of the wheel extends into the regeneration portion, so that the wheel can rotate through the supply air stream and the regeneration air stream to dehumidify the supply air stream. A heater warms the regeneration air stream as necessary to regenerate the desiccant wheel. The invention also comprises a hybrid system that combines air conditioning and dehumidifying components into a single integrated unit.

28 Claims, 6 Drawing Sheets

U.S. PATENT DOCUMENTS 5,542,259 A 8/1996 Worek et al. ..... 62/94
5,548,970 A 8/1996 Cunningham, Jr. ..... 62/271
5,551,245 A 9/1996 Calton et al. ..... 62/90
5,579,647 A 12/1996 Calton et al. ..... 62/94
5,649,428 A 7/1997 Calton et al. ..... 62/94
5,650,030 A 7/1997 Kyricos ..... 156/192
5,650,221 A 7/1997 Belding et al. ..... 442/417
5,660,048 A 8/1997 Belding et al. ..... 62/94
5,718,122 A 2/1998 Maeda ..... 62/185
5,727,394 A 3/1998 Belding et al. ..... 62/94
5,732,562 A 3/1998 Moratalla ..... 62/94
5,758,508 A 6/1998 Belding et al. ..... 62/94
5,758,509 A 6/1998 Maeda ..... 62/94
5,758,511 A 6/1998 Yoho et al. ..... 62/271
5,761,915 A 6/1998 Rao ..... 62/94
5,771,707 A 6/1998 Lagacé et al. ..... 62/271
5,782,104 A 7/1998 Sami et al. ..... 62/271
5,791,153 A 8/1998 Belding et al. ..... 62/93
5,817,167 A 10/1998 DesChamps ..... 95/113
5,826,434 A 10/1998 Belding et al. ..... 62/90
5,839,288 A 11/1998 Dotson ..... 62/94
5,860,284 A * 1/1999 Goland et al. ..... 62/94
5,890,372 A 4/1999 Belding et al. ..... 62/271
5,937,667 A 8/1999 Yoho, Sr. ..... 62/271
5,937,933 A 8/1999 Steele et al. ..... 165/10
5,953,926 A 9/1999 Dressler ..... 62/175
5,966,955 A 10/1999 Maeda ..... 62/238.3
6,003,327 A * 12/1999 Belding et al. ..... 62/271
6,018,953 A * 2/2000 Belding et al. ..... 62/94
6,029,462 A 2/2000 Denniston ..... 62/94
6,029,467 A 2/2000 Moratalla ..... 62/271
6,094,835 A 8/2000 Cromer ..... 34/80
6,155,060 A 12/2000 Parkman ..... 62/94
6,199,388 B1 3/2001 Fischer, Jr.
6,199,389 B1 3/2001 Maeda ..... 62/94
6,199,394 B1 3/2001 Maeda ..... 62/271
6,205,797 B1 3/2001 Maeda ..... 62/94
6,311,511 B1 11/2001 Maeda ..... 62/271
RE37,464 E 12/2001 Meckler ..... 62/93
6,328,095 B1 12/2001 Felber et al. ..... 165/54
6,355,091 B1 * 3/2002 Felber et al. ..... 95/10

* cited by examiner

DESICCANT-BASED DEHUMIDIFICATION SYSTEM AND METHOD

STATEMENT REGARDING FEDERALLY SPONSORED RESEARCH AND DEVELOPMENT

The U.S. Government has a paid-up license in this invention and the right in limited circumstances to require the patent owner to license others on reasonable terms as provided for by the terms of (DOE Prime Contract No. DE-AC05-00OR22725, ORNL Subcontract No. 62X-SV044V) awarded by the Department of Energy.

BACKGROUND OF THE INVENTION

The present invention pertains to the field of heating, ventilating, and air conditioning ("HVAC"). More particularly, this invention relates to systems and methods for controlling the temperature and humidity of an enclosed space.

The quality of indoor air has been linked to many illnesses and has been shown to have a direct impact on worker productivity. New research strongly suggests that indoor humidity levels may have a significant impact on the health of building occupants. For example, microbes such as mold and fungus, which proliferate at higher indoor humidity levels, have been shown to emit harmful organic compounds. In addition to direct health effects, often the primary air quality complaint of building occupants is unpleasant odors associated with microbial activity. Building operators often attempt to eliminate odors by increasing outdoor air quantities. This usually exacerbates the problem because increasing outdoor air quantities often results in higher indoor air humidity levels, which, in turn, fosters further microbial activity.

The HVAC industry has responded to these indoor air quality ("IAQ") concerns through its trade organization, the American Society of Heating, Refrigerating and Air-Conditioning Engineers ("ASHRAE"). ASHRAE Standard 62-1999, Ventilation for Acceptable Indoor Air Quality, sets minimum ventilation rates and other requirements for commercial and institutional buildings. Meeting these standards generally requires systems capable of providing an increased supply of outdoor air to the conditioned space while maintaining acceptable humidity levels within the space. A large body of research supports the need for continuous ventilation in accordance with ASHRAE 62-1999, while maintaining the relative space humidity between 30% and 60%. IAQ problems including unacceptable odors and microbial infestation often occur when HVAC systems fail to meet these design criteria.

Commercial and institutional facilities often use "packaged" units, which combine air conditioning, heating and sometimes air handling equipment in a single housing. Such systems are generally designed to provide inexpensive heating and cooling. Such packaged units are generally installed outside the building envelope, frequently at ground level or on the building roof. A typical packaged unit includes a supply fan and filter, a return air fan, a heating source (typically an indirect gas fired heater or electric heating coil), an outdoor air intake, and a mechanical refrigeration system consisting of a compressor, cooling coil, and a condensing coil with a fan that rejects heat to the outdoors. Typically a small fraction of outdoor air is mixed with a much larger fraction of return air from the building, conditioned by the unit then circulated through the building by means of a system of supply and return ductwork. The advantages of such packaged equipment include low purchase cost, simplicity, familiarity, and compact design. More than 80% of all air-conditioning systems sold to the commercial marketplace involve compressorized package equipment.

A significant shortcoming of such packaged HVAC units is that they are typically designed to utilize minimal outdoor air, and, as such, are frequently incapable of handling the increased continuous supply of outdoor air necessary to comply with ASHRAE 62-1999 guidelines. This is especially true in applications where the need for 100% outdoor air systems exist, such as makeup air to restaurants and hotel facilities. It is also true for applications like schools, movie theatres and other facilities where a high occupancy density results in the need for very high outdoor air percentages being provided by the HVAC system.

To meet the increased outdoor air requirements of the ASHRAE standards, HVAC professionals have attempted to use oversized packaged equipment to match the increased cooling load associated with higher outdoor air percentages. However, such oversized systems generally suffer from sub-par performance and are expensive to operate. As importantly, the oversized cooling capacity required to meet peak outdoor air load conditions proves excessive at the more common part-load conditions, and creates serious performance problems ranging from over-cooling the space and lost humidity control due to reduced compressor cycle times to freezing up coils and shortened compressor life. Therefore, providing outdoor air continuously presents a tremendous challenge to conventional packaged HVAC equipment.

For example, on mild, humid days (part-load conditions) an oversized packaged unit will quickly cool the space to a set temperature and then shut off the compressor. If the evaporator fan is kept running to maintain a continuous flow of outdoor air to the space, the indoor humidity level will usually climb due to the humidity level of the outdoor air being introduced. This increase in humidity will continue until the space temperature rises to the point that the thermostat once again calls for cooling. By this time, the humidity of the return air entering the cooling coil of the packaged HVAC system is elevated. The elevated humidity of the return air results in an elevated dew point temperature leaving the cooling coil. Typically, the system can maintain space temperature, but humidity control is lost, resulting in uncomfortable, cold, clammy conditions. Occupants will often respond by lowering the thermostat setting, causing the space relative humidity to further increase. If such high humidity conditions persist, microbial growth and other moisture-related IAQ problems may arise.

Another problem associated with oversized packaged equipment selected to process outdoor air on a continuous basis results from the re-evaporation of moisture that has condensed on the evaporator coil. Henderson et al. (1998) and Khattar et al (1985) both have confirmed the phenomenon, often observed in the field, where the actual moisture removed by a packaged HVAC unit is significantly less than anticipated based upon published performance data. Their research shows that this reduction in dehumidification capacity is attributable to moisture condensed on the direct expansion (DX) coil evaporating back into the supply air stream when the coil is cycled off but the fan continues to operate. Henderson (1998) has shown that evaporation of moisture condensed on the DX coil can reduce actual latent heat removal to less than 50% of the unit's capacity at part load conditions. (1) Henderson, H. 1998. The Impact of Part Load Air Conditioner Operation on Dehumidification Performance: Validating a Latent Capacity Degradation Model. Proceedings ASHRAE IAQ 98. (2) Khattar, M et. al. 1985. Fan Cycling Effects on Air Conditioner Moisture Removal Performance in Warm, Humid Climates. Presented at the International Symposium on Moisture and Humidity, Proceedings. April, 1985, Washington D.C. (3) Henderson, H. 1990. An Experimental Investigation of the Effects of Wet and Dry Coil Conditions on Cyclic Performance in the SEER Procedure. Proceedings of USNC/IIR Refrigeration Conference at Purdue University, West Lafayette, Ind. July, 1990.) These and other limitations present significant problems when packaged rooftop systems are forced to handle high percentages of outdoor air volume, particularly if operated as 100% outdoor systems. When applying a conventional packaged rooftop system to handle all outside air, the cooling tons required at peak conditions are far greater than the cooling output available at the rated airflow of the conventional unit. This occurs because standard conventional packaged cooling equipment currently available on the marketplace by the major HVAC equipment manufacturers is generally designed to accommodate only a relatively small portion of outdoor air, typically 10–20%.

For example, a typical packaged gas/electric rooftop unit available on the market today may have a rated cooling performance at 95° Fahrenheit (F) ambient, 80° F. coil entering dry bulb, 67° F. coil entering wet bulb in accordance with the ARI Standard 210/240-94. Assuming a typical ASHRAE/ARI outdoor air cooling design condition of 95° F. dry bulb and a 78° F. web bulb, and a return air condition of 78° F. dry bulb and 50% relative humidity, the mixed air condition entering the cooling coil of 80° F. and 67° F. wet bulb corresponds to an approximately 12% outdoor air percentage based on a simple mixed air calculation.

Therefore, the design standard used to rate standard packaged cooling equipment assumes that 80–90% of the air delivered to the cooling coil is conditioned return air from the space. This return air stream requires far less cooling capacity to condition than raw outdoor air during peak cooling design conditions. As such, the total cooling capacity needed by the standard conventional packaged equipment would be greater if it were designed to accommodate a much higher percentage of outdoor air.

For example, conditioning a 1,500 cubic feet per minute (cfm) outdoor air stream from 85° F. and 130 grains (enthalpy of 40.8 BTU/pound) to a 56° F. dew point (enthalpy of 23.8 BTU/pound) requires approximately 10 tons of cooling capacity based on a simple psychrometric calculation ((1500 cfm×4.5×(40.8–23.8)/12000 BTU/ton of cooling). However, the recommended minimum amount of air capacity that can be processed by a typical 10 ton unit (alternative 1) without potentially causing problems such as frosting and compressor failure is approximately 3,000 cfm (300 cfm/ton). If the unit is set up to provide 50% outdoor air (1,500 cfm), and 50% return air (1,500 cfm) for a total of 3,000 cfm across the cooling coil, the cooling capacity must be increased to a 15 ton (alternative 2) unit to accommodate the load associated with the extra 1,500 cfm of recirculated air. Problems such as coil frosting may be avoided in many cases, since the mixed air temperature to the cooling coil is much closer to the aforementioned design conditions of 80° F. and 67° F. wet bulb. Examples of alternatives 1 and 2 are presented below.

If a standard 10 ton system is operated with only 1500 cfm of air passing across the coil (only 150 cfm/ton), and if this air is all outdoor air, the full 10 tons of cooling will be required to reach a supply condition with a 56° F. dew point. However, when the outdoor air drops from the peak design condition of 95° F. and 78° F. wet bulb to say 78° F. and 64° F. wet bulb, the 10 ton compressor will deliver air as cool as 30° to 34° F. At this point, the refrigeration pressure and temperature will be very low, low enough to cause the moisture condensed on the cooling coil to freeze. This frost buildup can result in increased pressure loss across the cooling coil, which results in a reduction of airflow, which results in more significant frost formation. This and other problems associated with operating conventional DX cooling systems at reduced airflow are well known to the industry and those skilled in the art of refrigeration.

By applying a 15 ton system to process a total of 3,000 cfm, 1,500 cfm of which is outdoor air with the remainder being return air, the mixed air condition to the coil is decreased from the 95° F. and 78° F. wet bulb mentioned in the previous example to approximately 86.5° F. and 72° F. web bulb. At the peak condition, the 15 tons will provide a supply condition having a dew point of approximately 56° F. At the part load condition used previously, 78° F. and 64° F. wet bulb, the supply air condition will be approximately 40° F. At this condition, the refrigerant temperature is not as cold as the previous example, and therefore may allow the coil to be operated without freezing under part load condition.

However, using the increased cooling tons and supply airflow may cause other operational problems. The higher 3,000 cfm supply airflow quantity may, for example, overcool the space, especially at part-load conditions. This cooling causes the compressor to cycle off, resulting in the delivery of high humidity air directly to the space in addition to the moisture evaporated from the cooling coil if the supply air fan continues to run. If, as a third alternative, a 10 ton unit is used to process the 3,000 cfm of total airflow, of which 1,500 cfm is outdoor air, at typical cooling season latent design condition of 85° F. and 130 grains, most conventional packaged units of this size are only capable of delivering air at a dew point of approximately 59° F., even at a favorable, return air condition of 75° F. and 60% relative humidity, and would therefore be incapable of maintaining the space at the desired level of 50% relative humidity, since a dew point of approximately 55° F. is required even if there is no latent load generated by people or infiltration.

Customized overcooling reheat systems have been used in an attempt to overcome these problems. However, such systems are expensive to purchase and operate. Furthermore, complicated refrigeration circuits frequently employed by such systems can be difficult to troubleshoot and expensive to maintain. An example of the complexity required to deliver a packaged piece of equipment to effectively condition outdoor air is the TRANE® FAU product recently introduced to the marketplace. The TRANE® Applications Considerations Bulletin MUA-PRC004-EN shows a system that includes two separate evaporator coils (an outdoor air evaporator and a main evaporator), three separate condensing coils (a reheat condenser, a reheat outdoor condenser and a main condenser), one reheat compressor, three main compressors, two expansion valves, a subcooler and multiple complex controls.

Another attempt to meet the outdoor air and humidity level requirements of the ASHRAE standards is through the use of "active" desiccant-based systems, desiccant systems that employ a heated regeneration air stream to remove moisture from the air. These active desiccant systems have been used to reduce the humidity of outdoor air prior to its introduction to the conventional HVAC system or directly to the conditioned space. This allows the packaged equipment to better control the space humidity despite increased outdoor air requirements. Desiccants can be solid or liquid substances that have the ability to attract and hold relatively large quantities of water. In many commercial air conditioning applications where desiccants are used, the desiccant is in a solid form and absorbs moisture from the air to be conditioned. Examples of these types of desiccants are silica gel, activated alumina, molecular sieves, and deliquescent hygroscopic salts. In some cases, these desiccants are contained in beds over which the air to be conditioned is passed. Many times, however, the desiccant is contained in what is known as an "active desiccant wheel."

An active desiccant wheel is an apparatus typically comprising closely spaced, very thin sheets of paper, polymer film or metal which are coated or impregnated with a desiccant material. The wheel is usually contained in duct work or in an air handling system that is divided into two sections: a supply section and a regeneration section. The wheel is rotated slowly on its axis such that a given zone of the wheel is sequentially exposed to the two sections. In the supply section, the desiccant is contacted by the supply/outdoor air. In this section, the desiccant wheel dehumidifies the supply/outdoor air stream by absorbing moisture from the air onto its desiccant surface. In the regeneration section, the desiccant contacts a regeneration air stream (e.g., return/exhaust air being discharged from the space or raw outdoor air). This regeneration air desorbs the moisture from the desiccant that was adsorbed from the supply/outdoor air. A heater is often used to heat the regeneration air stream as needed to regenerate (i.e., dry) the desiccant wheel as it rotates through the regeneration air stream. By cycling the wheel through these two air streams, the adsorbing/desorbing operation of the wheel is continuous and occurs simultaneously.

In the past, most active desiccant preconditioning systems have not been coupled with rooftop packaged equipment, but applied as stand alone systems. When they have been coupled with rooftop packaged equipment, they have been positioned upstream of the packaged unit in an attempt to control the humidity of the air entering the conventional vapor compression system. Such systems have processed the outdoor air by first passing it through an active desiccant wheel to handle most of the latent load (humidity control), then post-cooling the resulting warm, dehumidified outdoor air as necessary to meet the temperature requirements of the conditioned space. However, this approach generally has not found market acceptance because of the relatively high purchase cost, high operational cost, large size and inefficiency of such systems.

When an active desiccant dehumidification wheel removes moisture from an air stream, heat is released as a result of the adsorption process in addition to the heat contained within the warm wheel media as it rotates from the hot regeneration air stream. The more moisture absorbed, the more heat released. This heat significantly increases the supply air temperature. In addition, removing large quantities of moisture from outdoor air (e.g., 60 grains) requires a high temperature air stream to regenerate the desiccant. In active desiccant wheels, this high regeneration temperature is supplied by an external heat source (e.g., a gas-fired heater). As mentioned, the heat imparted to the desiccant wheel further increases the supply air temperature. Based upon the literature for one of the best performing commercially available active desiccant wheels, a 60 grain reduction in outdoor air humidity would produce a 50° F. increase in the outdoor air temperature. Herein lies a significant problem with the active desiccant preconditioning approach. If the desiccant wheel handles all or most of the outdoor air latent load, the amount of post cooling required to remove the sensible heat added by the dehumidification process will often be similar to that required to remove the humidity without the desiccant system. Consequently, this approach generally does not reduce the overall system energy consumption (total BTUs); rather, it increases it.

Another shortcoming of desiccant preconditioning approaches attempted heretofore is that such systems have required very large desiccant wheels to handle the significant latent load. For example, to process only 1500 cfm of outdoor air, active desiccant wheels as large as 42 inches have been applied. Including a standard cassette and drive assembly, the height and width of the wheel unit required is approximately 5 feet tall while a typical rooftop unit processing the same amount of air is only 33 inches tall. Most prior active desiccant systems have also employed a second, sensible only energy recovery wheel to mitigate much of the process heat gained as a result of the adsorption process. The size of the system required to accommodate these two wheels, regeneration and other components required is often four to five times the size of a comparable rooftop package unit. These large systems are particularly undesirable for commercial rooftop HVAC applications because they are more difficult to install, require greater structural reinforcement, and are less attractive. Architectural, engineering, economic and environmental considerations all drive the desire to reduce the size and weight of such packaged HVAC equipment.

Therefore, there is a significant need for energy-efficient, compact HVAC system that can effectively control the temperature and humidity of an indoor space while simultaneously providing high quantities of outdoor air to the space. The present invention provides these and other advantageous results.

SUMMARY OF THE INVENTION

The present invention provides systems and methods for controlling the temperature and humidity of air supplied to an enclosed space.

An apparatus of the present invention for dehumidifying air supplied by an air conditioning system includes a housing having a partition separating the interior of the housing into a supply portion and a regeneration portion. The supply portion has an inlet for receiving supply air from the leaving side of the air conditioning system cooling coil and an outlet for supplying air to the enclosed space. The regeneration portion has an inlet for receiving regeneration air and an outlet for discharging regeneration air. A fan in air flow communication with the regeneration portion creates a regeneration air stream.

The apparatus includes a rotatable desiccant wheel, which is preferably sized to handle approximately ⅓ of the air flow processed by the air conditioning system. The desiccant wheel preferably positioned substantially collinear or parallel to the partition such that a portion of the wheel extends into the supply portion and a portion of the wheel extends into the regeneration portion. The desiccant wheel rotates through the supply air stream and the regeneration air stream to dehumidify the supply air stream. The apparatus preferably includes a mechanism for varying the rotational speed of the desiccant wheel to control the amount of moisture removed from the supply air stream or heat transferred to the supply air stream. The apparatus also preferably includes a bypass damper between the inlet and the outlet side of the supply air portion around the active desiccant wheel for controlling the amount of supply air passing through the desiccant wheel. The bypass damper can also be modulated to accommodate varying outdoor air and desired supply air conditions by selectively bypassing the desiccant wheel.

A heat source (e.g., a direct-fired gas burner, indirect-fired burner or heating coil) warms the regeneration air stream as necessary to regenerate the desiccant wheel as it rotates through the regeneration air stream. Heated air that is a byproduct of an air conditioning system, a manufacturing process, and/or an electrical generation plant, for example, may also serve as the regeneration source. The apparatus can also include a duct or opening connecting the regeneration inlet air to the compartment that houses the air conditioning condenser to allow the regeneration heater inlet air to be preheated by the condenser coil.

The present invention also includes a hybrid air conditioning and dehumidifying apparatus and methods for using the apparatus to control the temperature and humidity of air supplied to an enclosed space. The hybrid unit includes a housing having a partition that separates the housing into a supply portion and a regeneration portion. The supply portion has an inlet for receiving air and an outlet for supplying air to the enclosed space. The regeneration portion has an inlet for receiving regeneration air and an outlet for discharging regeneration air. A fan in air flow communication with the regeneration portion creates the regeneration air stream and a fan in air flow communication with the supply portion creates the supply air stream. A cooling coil cools and/or dehumidifies the supply air stream. A bypass damper can be positioned in the supply section to allow a portion of the supply air leaving the cooling coil to bypass around the active desiccant wheel, preferably allowing approximately ⅓ of the supply air flow to pass through the desiccant wheel under normal operating conditions. A rotatable desiccant wheel positioned downstream of the cooling coil further dehumidifies the supply air stream. A portion of the desiccant wheel extends into the supply portion and a portion of the wheel extends into the regeneration portion, so that the wheel can rotate through the supply air stream and the regeneration air stream to exchange moisture between the air streams. A heat source heats the regeneration air stream as necessary to regenerate the desiccant wheel as it rotates through the regeneration air stream.

DRAWINGS

These, and other features, aspects and advantages of the present invention will become more fully apparent from the following detailed description, appended claims, and accompanying drawings where:

Figure 1:
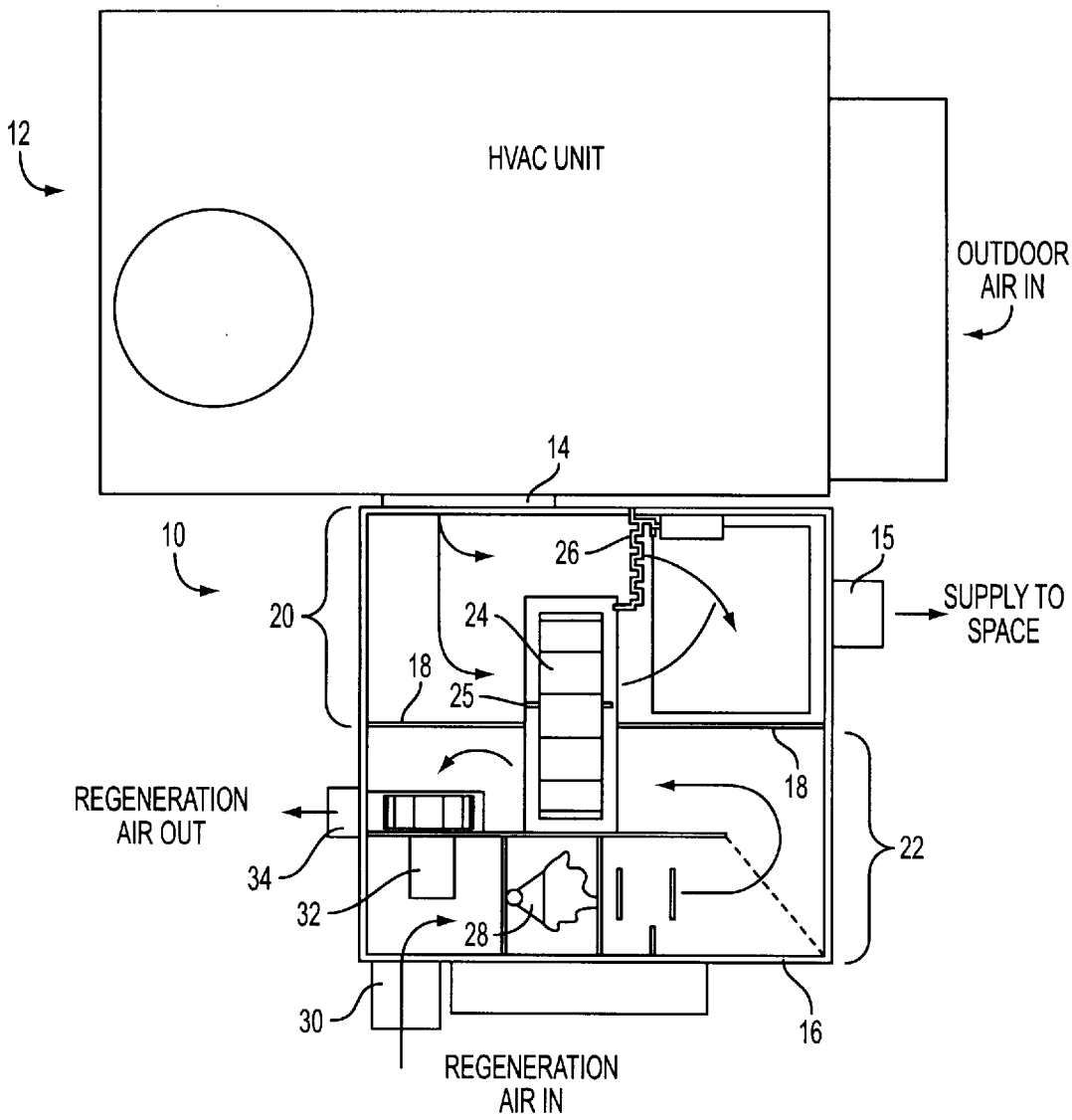
FIG. 1 is a schematic top view of an apparatus for dehumidifying air supplied to an enclosed space by an air conditioning system.

For simplicity and clarity of illustration, the drawing figures illustrate the general manner of construction, and descriptions and details of well-known features and techniques are omitted to avoid unnecessarily obscuring the invention.

DESCRIPTION OF THE PREFERRED EMBODIMENTS

The present invention applies a desiccant wheel in conjunction with an air conditioning unit in a configuration designed to take best advantage of the desiccant wheel and cooling coil to efficiently produce very dry air, while minimizing the size and cost of the combined system.

Figure 2:
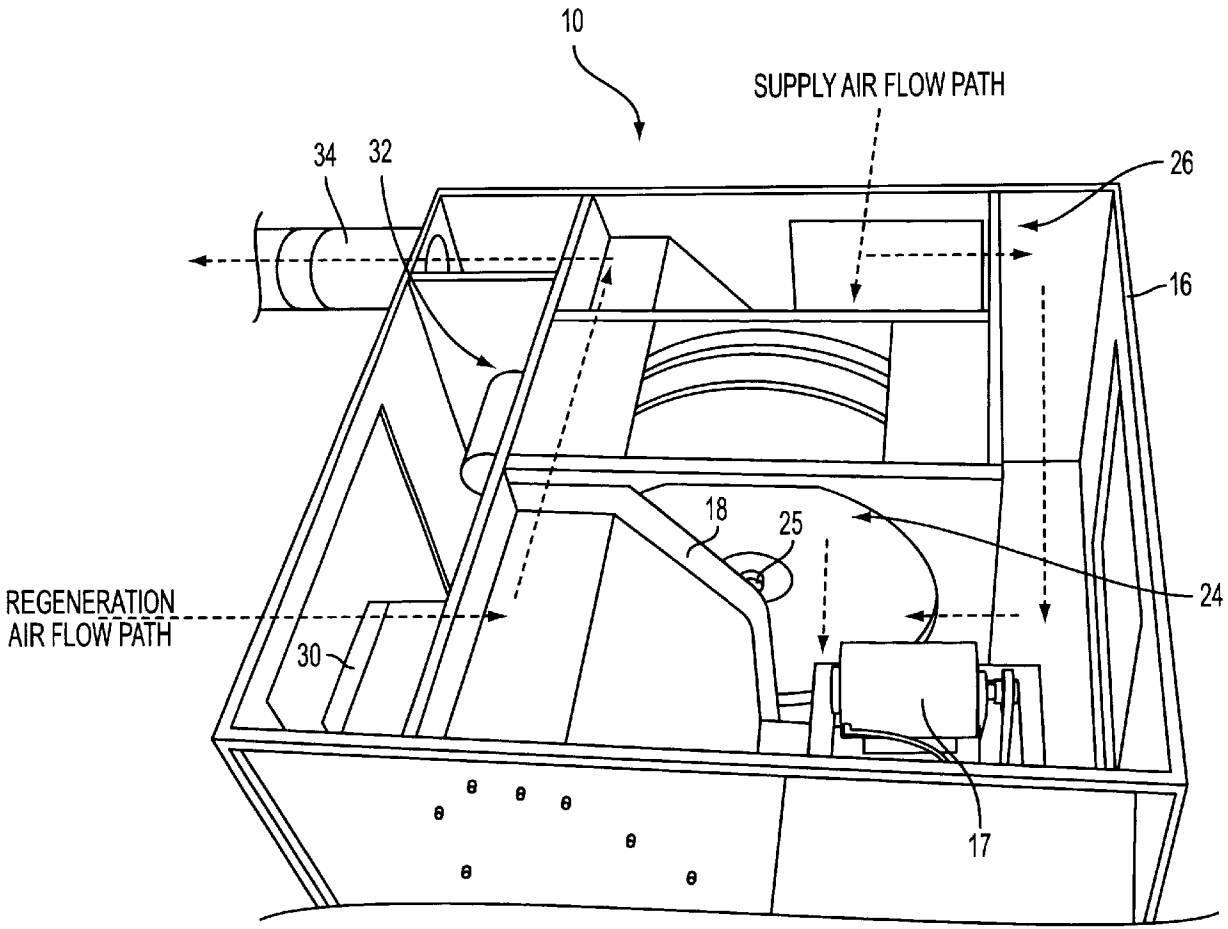
FIG. 2 is a partially broken away perspective view of an apparatus for dehumidifying air supplied to an enclosed space by an air conditioning system.

FIGS. 1 and 2 illustrate an embodiment of a system for controlling the humidity of air leaving an air conditioning unit and entering a conditioned space. An active desiccant module (ADM) 10 is positioned to condition outdoor air downstream of the evaporator coil of a standard HVAC unit 12. In the embodiment shown, the air conditioning system is an HVAC unit. However, depending upon the system requirements, an air conditioning unit (without heating and/or ventilating components) can be used in place of the HVAC. The HVAC unit 12 can be any conventional HVAC unit. In a preferred embodiment, the HVAC unit 12 is a standard commercially-available packaged HVAC unit, for example, a TRANE® VOYAGER™ rooftop unit. The HVAC unit 12 is preferably mounted in a standard horizontal position. A short transition duct connects the HVAC unit 12 to the inlet 14 of ADM 10. Supply air leaving the HVAC unit 12 flows into the supply air inlet of the ADM 10 in the direction indicated by the arrows on FIGS. 1 and 2. The supply fan of the conventional HVAC unit 12 will, in most cases, provide the desired airflow without the need for an additional booster fan. However, the system can include a supplementary supply fan 17 if desired.

The ADM 10 includes a housing 16 that surrounds the unit. A partition 18 separates the unit into a supply air portion 20 and a regeneration air portion 22. A regeneration air stream flows through the regeneration portion 22 of the ADM 10 in the direction shown by the arrows. A desiccant wheel 24 is positioned between the supply air portion 20 and regeneration air portion 22. The wheel 24 preferably has an axis of rotation 25 positioned substantially collinear or parallel to the partition 18. The desiccant wheel 24 is positioned to rotate through separate supply and regeneration air streams flowing through the respective portions of the ADM 10. The wheel 24 preferably includes a drive belt, which operates with a conventional drive motor to rotate the wheel at a controlled speed. The wheel housing preferably includes air seals to prevent air from escaping around the edges of the rotating wheel 24. The ADM is preferably provided with a main control panel housing the main system controls.

The desiccant wheel 24 may comprise any one of various devices that removes latent energy (moisture) from one air stream and transfers this latent energy to another air stream. In a preferred embodiment the active desiccant wheel 24 is a rotary, desiccant coated, honeycomb fluted matrix. The honeycomb matrix is made from a desiccant coated substrate material such as very thin aluminum, fibrous paper or polymeric materials to minimize conductivity and heat transfer. In a preferred embodiment, the substrate material is evenly and densely coated on both surfaces prior to being formed in the honeycomb matrix to ensure that inner walls of the resulting flutes or channels are essentially smooth thereby minimizing parasitic pressure loss through the wheel matrix and maximizing the moisture storage capacity. The preferred desiccant wheel utilizes a desiccant coating optimized to provide the maximum amount of dehumidification or moisture adsorption/absorption capacity when operated under moderate regeneration temperatures ranging between approximately 175° F. and 220° F., although somewhat higher or lower regeneration temperatures may also be used under some conditions. The desiccant coating should also preferably adsorb or absorb moisture very effectively from a cool, saturated air stream, then readily desorb the moisture when the wheel media is rotated through the regeneration air stream. The desiccant wheel preferably provides the desired moisture removal at relatively high face velocities (greater than about 500 feet per minute) through the active desiccant wheel matrix while minimizing pressure loss (less than about 0.6 inches of water gauge).

The desiccant wheel 24 preferably is one having a very low-pressure loss because it is advantageous to use a supply fan in the HVAC unit 12 as the sole means of delivering air to the space. External static capability is limited because most packaged units use forward curve fans. The desiccant wheel 24 is preferably optimized for best performance at moderate regeneration temperatures and with saturated inlet conditions. A desiccant used for such a wheel desirably has as high a water adsorption capacity as possible and therefore as much useable desiccant mass on the wheel as is consistent with technical and economic constraints (desirably, coating thickness of more than one mil). Furthermore, although non-desiccant mass is required to carry and support the desiccant material, the wheel preferably has as little non-desiccant mass as possible because such mass increases the weight of the wheel and reduces the wheel's dehumidification capacity.

Desiccant materials may include, for example, A-type, X-type or Y-type molecular sieves and other zeolites, various silica gels, activated alumina, lithium chloride and other deliquescent salts, hydrophobic polymers or other materials capable of adsorbing or absorbing water vapor from an air stream. In a preferred embodiment, a desiccant material that is capable of adsorbing/absorbing and desorbing a high percentage of its own weight in water vapor while processing a cool, humid air stream typical of that leaving a cooling coil is desired. The preferred desiccant material should also operate to provide the desired moisture removal capacity at design conditions while utilizing a moderate regeneration air temperature ranging from about 175° F. degrees to about 220° F., although it is understood that desiccants requiring higher or lower regeneration temperatures may also be configured to deliver acceptable conditions. Finally, it is beneficial to minimize the amount of adsorption energy generated as the moisture is absorbed/adsorbed onto/into the surfaces of the desiccant material, so that the amount of heat and introduced to the dehumidified air stream leaving the active desiccant wheel can be kept to a minimum when desired.

Desiccant materials that have moisture isotherms that meet these criteria include select Y type molecular sieves and most silica gel desiccants and specifically larger pore, low density silica gel powders that are capable of adsorbing a very high percentage of their own weight when subjected to high relative humidity environments.

Laboratory and recent field test prototypes of the invention have utilized an active desiccant wheel developed by SEMCO Incorporated, which provides acceptable performance and meets the criteria outlined previously for this component. The SEMCO model LT active desiccant wheel employs a deep (270 mm depth) desiccant wheel media with relatively large, sinusoidal flute openings having an approximate dimension of 1.5 millimeters in height and 4.2 millimeters in width. This media allows for the desired dehumidification performance while meeting the low pressure loss criteria required to allow the existing fan in the packaged rooftop unit to be capable of processing the desired airflow through and around the active desiccant wheel without the need for an additional booster fan in most cases.

The active desiccant wheel utilizes a very thin aluminum base substrate material having a thickness of approximately 1.2 mils, coated on both sides with a composite mixture of a high surface area Y type molecular sieve and silica gel desiccant materials. This wheel is capable of providing the moisture adsorption capacity and performance desired and as presented in Tables 1 and 2 below.

The desired performance has been obtained while utilizing relatively high supply air face velocities through this particular active desiccant wheel. For example, the standard 5 ton HVAC unit tested to provide the performance data presented in Tables 1 and 2 utilized a wheel having a diameter of approximately 20 inches. The net face area allocated to process the supply air stream was approximately 0.93 square feet after compensating for the outer rim, internal hub cover plate, the spokes and the seals. This wheel processed approximately 36% of the 1400 total cfm, or 504 standard cubic feet per minute (SCFM), during the testing completed to obtain the performance data presented in Tables 1 and 2. Dividing the 504 standard cubic feet per minute processed by the 0.93 square feet of net face area confirms a wheel face velocity of approximately 542 feet/minute.

The rotational speed of the active desiccant wheel 24 may be adjusted to optimize the amount of dehumidification capacity and/or reheat capacity sought. For example, in a preferred embodiment, the speed of the desiccant wheel varies from a minimum of about ⅛ to about ½ rotations per minute (rpm) when in the dehumidification mode and as high as about 8 rpm if used to provide winter heating of the outdoor air. By modulating the rotational speed of the desiccant wheel the amount of regeneration heat that is transferred to the supply air stream can be varied.

At the lower speeds (e.g., ⅛ rpm), the carry-over heat will be reduced. Reducing the amount of heat transfer is beneficial when it is desirable to provide dehumidified air to the occupied space that is as cool as possible. Such conditions typically arise on warm, sunny days when the sensible space load is high.

At higher speeds (e.g., ½rpm), the carry-over heat will be increased. Increasing the amount of heat transfer is beneficial when it is desirable to provide dehumidified warm air to the occupied space. Such conditions typically arise, for example, on cloudy, rainy days when the space has a high latent load and a very low sensible load.

Under most conditions, optimum dehumidification capacity is achieved at an intermediate wheel speed of about ⅕ to ⅓ rpm. At these speeds, the maximum amount of moisture is removed at most of the conditions encountered during normal operation. The dehumidification capacity will typically be reduced as the wheel speed is decreased or increased appreciably from this intermediate speed. Particularly when systems are built in accordance with this invention, and do not choose to incorporate the modulating valve (variable regeneration temperature capability) on the regeneration source, it will be advantageous at times to reduce the speed of the active desiccant wheel below this optimum range, sacrificing some of the dehumidification capacity in exchange for the delivery of colder, less dry air from the system. For example, during times when the space humidity is satisfied but could benefit from additional cooling, the wheel speed would be gradually reduced until either the space humidity was no longer satisfied or the temperature within the space was as desired. Conversely, it will be advantageous at times to increase the speed of the active desiccant wheel above this optimum range, sacrificing some dehumidification capacity in exchange for the delivery of warmer, less dry air from the system. For example, during times when the space humidity is satisfied but is cooler than desired, the wheel speed would be gradually increased until either the space humidity was no longer satisfied or the temperature within the space was as desired.

By adjusting the rotational speed of the desiccant wheel, the system of the present invention can provide the further advantage of providing supplemental heat for conventional HVAC units. During the heating season, many standard packaged rooftop units do not have enough heating capacity to accommodate high outdoor air percentages on very cold days. Typical packaged units lack such heating capacity because they are usually designed to process a minimal amount (about 15%) of outdoor air with most of the air entering the heater being return air from the space. For example, a TRANE® 10 ton packaged unit model YSC120A has a 202,500 British thermal unit (BTU) output indirect-fired gas heating section. At the rated airflow of 4,000 cfm and with the outdoor air at 20° F., the supply air temperature will only be 67° F., too cold to heat most spaces. By adding an additional 73,000 BTUs of heat using the active desiccant wheel, the supply air temperature can be raised to 84° F. This is accomplished by raising the temperature of the 1350 cfm (⅓ of the total airflow) passed through the active desiccant wheel by 50° F. In order to avoid further dehumidification of the outdoor air by the active desiccant wheel and to optimize the heating efficiency function of the desiccant wheel (in this example, used as an indirect-fired heat exchanger) the wheel speed can be increased to the maximum setting of approximately 8 rpm.

The method and system of the present invention is particularly useful when used in conjunction with conventional HVAC units having electric heaters. A primary geographic market for the dehumidification module described herein is areas where outdoor humidity levels are typically high (often described as hot and humid climates). Such markets typically do not experience long or extreme heating seasons. Because heating requirements are minimal, packaged HVAC units sold in these regions typically have electric heating coils. The electric heating capacity provided is often not adequate for heating high outdoor air percentages, even in mild climates. For example, the standard TRANE® model TC061C3 has a maximum electric heating output of 23 kW. This 5 ton unit, processing 2,000 cfm, is therefore capable of heating an outdoor air stream from 30° F. to only 66° F. The supplemental heating capacity offered by the dehumidification module described herein facilitates use of electric heating despite the high outdoor air percentages, and also allows for a possible reduction in the size of the electric heating coil required.

In an embodiment of the invention, wheel speed reduction and modulation is accomplished by a variable speed motor controller, such as a frequency inverter, coupled with the motor driving the active desiccant wheel. The drive motor can drive a belt around the wheel, a friction wheel riding on the outer rim of the active desiccant wheel, or be directly coupled to the shaft of the desiccant wheel. A signal is provided to the frequency inverter from the system control module or the building automation system to deliver the desired supply air conditions.

The active desiccant wheel 24 is positioned downstream of the cooling coil of the HVAC unit 12. As discussed in greater detail below with reference to FIGS. 5 and 6, if the active desiccant wheel were to be placed upstream (before) the cooling coil, the desiccant wheel 24 would have to be much larger. A wheel positioned before the cooling coil must process all of the outdoor airflow to reach the desired moisture content leaving the active desiccant wheel. Since typically more humidity would have to be cycled by the active desiccant wheel located in this arrangement, and since the entering outdoor air would almost always be at a lower relative humidity than that leaving a wet cooling coil (near saturation), the velocity of the air passed through the active desiccant wheel would likely have to be lower than if the same wheel were installed after the cooling coil as described herein.

When the active desiccant wheel is positioned to process outdoor air before the cooling coil, it must remove far more pounds of moisture than if it is positioned downstream of the cooling coil as described herein, to produce the same desired supply air moisture level to the conditioned space. In order to remove the much larger moisture loads required, the active desiccant wheel positioned upstream of the cooling coil must be operated at lower face velocities and/or at much higher regeneration temperatures than is required by the active desiccant wheel positioned downstream of the cooling coil. The higher moisture loads and regeneration temperatures required by active wheels installed upstream of the cooling coil results in much more heat being added to the air leaving the active desiccant wheel. Consequently, more energy is required to cool the air before it is supplied to the conditioned space. Also, prior active desiccant preconditioning approaches have required far more regeneration energy than the system of the present invention because the desiccant wheel processes more air and removes more moisture.

The desiccant wheel 24 is preferably sized to process approximately 33% of the air that passes across the cooling/heating coil of the packaged HVAC unit 12. Sizing the active desiccant wheel to process only a fraction of the total supply air stream is beneficial to the overall size, performance and manufacturing cost of the active desiccant module, three of the most important criteria for market acceptance of this technology. Previous active desiccant systems have been designed to process all of the outdoor air through the active desiccant wheel. As a result, the size of the desiccant wheel required by previous active desiccant systems is much larger than required by the system described herein. If the size of the wheel is larger, the overall size of the system is larger. Since the active desiccant wheel has traditionally been the most costly component in the overall system, the larger wheel results in higher manufacturing cost.

The reduced size, manufacturing cost and increased energy efficiency associated with the positioning of the active desiccant wheel and the ability to process only a small fraction of the supply air stream made possible by the present invention described herein are only some of the more important and significant advantages offered. Other equally important advantages, including, for example, improved control options also exist.

Another significant advantage of this invention is that the amount of bypass air can change from application to application or within a given application to meet latent and sensible load requirements. A modulating bypass damper 26 is positioned in the supply air portion of the ADM 10 to maintain the desired flow through the desiccant wheel 24. The supply air stream flows through the bypass damper 26 and/or desiccant wheel 24 to the conditioned space via outlet 15. Bypass damper 26 may be modulated from a completely closed position to variable opened positions to control the flow through desiccant wheel 24 or to completely bypass the desiccant wheel 24 during the heating mode if desired. This configuration provides saturated air to the desiccant wheel to maximize its operating effectiveness and minimize the required regeneration temperature.

There are several advantages offered by this control option. By moving more air through the desiccant wheel, dryer, warmer air will be delivered by the system. By bypassing more air, cooler, less dry air will be provided. The ability to modulate the bypass air fraction allows the unit to cost effectively respond to changing space sensible/latent load conditions, especially when the regeneration energy is fixed. Another advantage offered by bypass air modulation is that during a true "economizer" period, (when the outdoor conditions are cool and dry enough to deliver directly to the space without further conditioning) the desiccant wheel can be bypassed to reduce the system internal static pressure and provide more outdoor air to the space.

The preferred mechanism for modulating the damper is an electric actuator. The percentage of open area of the damper, and therefore the amount of air bypassing the active desiccant wheel, is controlled by the installation of a modulating actuator such as those manufactured by the Belimo or Siemans companies (for example the Belimo model CM-24SR). A temperature and/or humidity sensor can provide a signal to a control module. This control module can be, for example, a direct digital control system or a simple combined temperature sensor controller or space thermostat. The controller processes the data from the sensors and sends a signal (for example a 0–10 volts or 4–20 mA) to the actuator, causing it to open or close the bypass damper to the extent necessary to provide the desired supply air temperature and/or humidity conditions from the unit or to maintain conditions within the conditioned space. Those skilled in the art will appreciate that various other mechanisms for modulating the damper are possible.

The desiccant wheel 24 is preferably an active desiccant wheel. As used herein, the term "active desiccant wheel" refers to a desiccant wheel that utilizes an external heat source to regenerate the desiccant within the wheel media. In the examples shown in FIGS. 1 and 2, the regeneration portion 22 of the ADM 10 includes a heat source comprising a heater 28 for regenerating the desiccant wheel 24. Regeneration heat can be provide by any heat source (e.g., gas, electric, hot water, steam, solar, waste heat from air conditioning, mechanical or electrical generating systems, etc.) capable of providing heat as required to regenerate (dry) the desiccant wheel 24 as it passes through the regeneration air stream. For example, heater 28 can be a direct-fired burner such as an atmospheric line-burner. The heater 28 can also be a hot water or steam coil, which may be preferred if waste heat is utilized for regeneration of the desiccant wheel 24, if, for example, the ADM 10 is used indoors or with a combined cooling, heating and power (CCHP) system (where on-site power generation creates waste heat as a by-product). Outdoor air is preferably drawn into the regeneration portion 22 via regeneration air inlet 30 by a regeneration air fan 32 in air flow communication with the regeneration portion 22. As used herein, the term "in air flow communication" refers broadly to a fan or other air moving means positioned anywhere inside or outside the apparatus so as to create the desired air steam. The heated regeneration air stream flows through and regenerates (dries) the portion of the desiccant wheel 24 rotating through the regeneration portion 22. After passing through desiccant wheel 24, the regeneration air can be discharged to the outdoors via regeneration air outlet 34.

The regeneration energy input can be modulated by a control valve serving the direct fired gas burner to provide only the amount of heat necessary to reach a desired dew point. A typical application for this approach would be conditioning a school facility where the desire is to provide a constant supply of dehumidified outdoor air to each classroom conditioned to a specified dew point. As the outdoor conditions change, the regeneration temperature is varied until the desired delivered outdoor air condition is achieved. As mentioned previously, the amount of regeneration energy can also be modulated to avoid delivering air to that space that is cooler than desired, even if the delivered dew point is being achieved. Likewise, the energy input can be modulated when the active desiccant wheel is used to provide a supplemental heating function.

There are many common ways to vary the energy input to a heating device and those skilled in the art would be familiar with these methods. The preferred regeneration source for the invention is a direct-fired gas burner. The quantity of gas, and therefore the heating output, is controlled by the installation of a modulating butterfly valve in the gas piping prior to or "upstream" of the burner module. This modulating butterfly valve is then opened and closed as required by an actuator, of which many types are available and known to those skilled in the art. A good example of which is a rotary actuator manufactured by Eclipse Inc., model number ACT004. A temperature and/or humidity sensor provides a signal to a control module. This control module may be, for example, a direct digital control system or a simple combined temperature sensor controller or space thermostat. The controller processes the data from the sensors and sends a signal (for example a 0–10 volts or 4–20 mA) to the actuator, causing it to open or close the butterfly valve to the extent necessary to provide the desired regeneration temperature for the conditions encountered.

The regeneration energy input can also remain constant, eliminating the added cost of the modulating valve and necessary control components. The burner or other heat source can be cycled much the same way a standard rooftop unit cycles both the cooling coil and heating source. A dew point sensor can be placed in the occupied space to control the cycling on and off of the regeneration heater and the appropriate stages of cooling. When the dew point sensor detects that space humidity is at a desired level, either the DX section continues to run to provide further sensible cooling if needed, based on the space thermostat setting, or if the space dew point sensor and thermostat are satisfied, both the regeneration heater and cooling coil stage or stages can be cycled off.

Hot gas or condenser heat can be used to augment the ADM's regeneration energy requirement. When a packaged rooftop HVAC unit is designed for optimum efficiency, the temperature of the condenser heat is typically in the range of 125° F. This heat creates many "free" BTU's available for regeneration. This free heat can be utilized, for example, by placing a second condenser coil prior to the gas fired burner. However, this configuration has the drawbacks of added equipment cost and controls complexity associated with the addition of the second condenser coil, piping, control valves and sensors. Also, the added pressure drop across the second condenser coil located upstream of the gas burner increases the cost of operating the regeneration fan and often increases the size of the required fan motor. A preferred method of utilizing this free heat is by drawing the regeneration inlet air from the compartment that houses the condenser fan(s), condenser coil and compressors to preheat the air entering the regeneration heater, eliminating the need for a second condenser coil or controls modifications. This configuration improves energy efficiency without increasing equipment cost. This approach can increase the temperature of the inlet air entering the regeneration heater by up to approximately 25° F., providing a significant reduction in energy required for regeneration heat.

The system of the present invention is particularly effective when applied in conjunction with an HVAC system that is configured to provide a high percentage of outdoor air to the conditioned space. However, those skilled in the art will appreciate that the approach can be effectively applied to applications requiring recirculated air as well. Even 100% outdoor air systems often benefit from the incorporation of a non-occupied mode. For example, if the system of the present invention is used to condition outdoor air supplied to a school, the classrooms will be unoccupied a very high percentage of the time. All summer long, the school facility may not require comfort cooling, but it nevertheless requires humidity control to avoid microbial infestation. The system of the present invention can be configured to allow for the reduction or elimination of outdoor air delivery in lieu of recirculated air. By passing the recirculated air through the ADM, the space humidity can be dehumidified to a very low dew point, with minimum runtime. In addition, the dehumidified air can be efficiently delivered at a room-neutral temperature to avoid over-cooling spaces with minimal sensible load. The space dew point can be monitored and the ADM activated only when the space needs dehumidification.

In another embodiment of the present invention, the ADM is configured as part of a fully integrated hybrid air conditioning and dehumidifying unit. The hybrid unit preferably combines in a single packaged system, the filtration, supply air fan, and DX evaporator coil and condensing section and heating section and other components typically found in the standard rooftop HVAC unit with the components of the ADM as discussed above.

Figure 3:
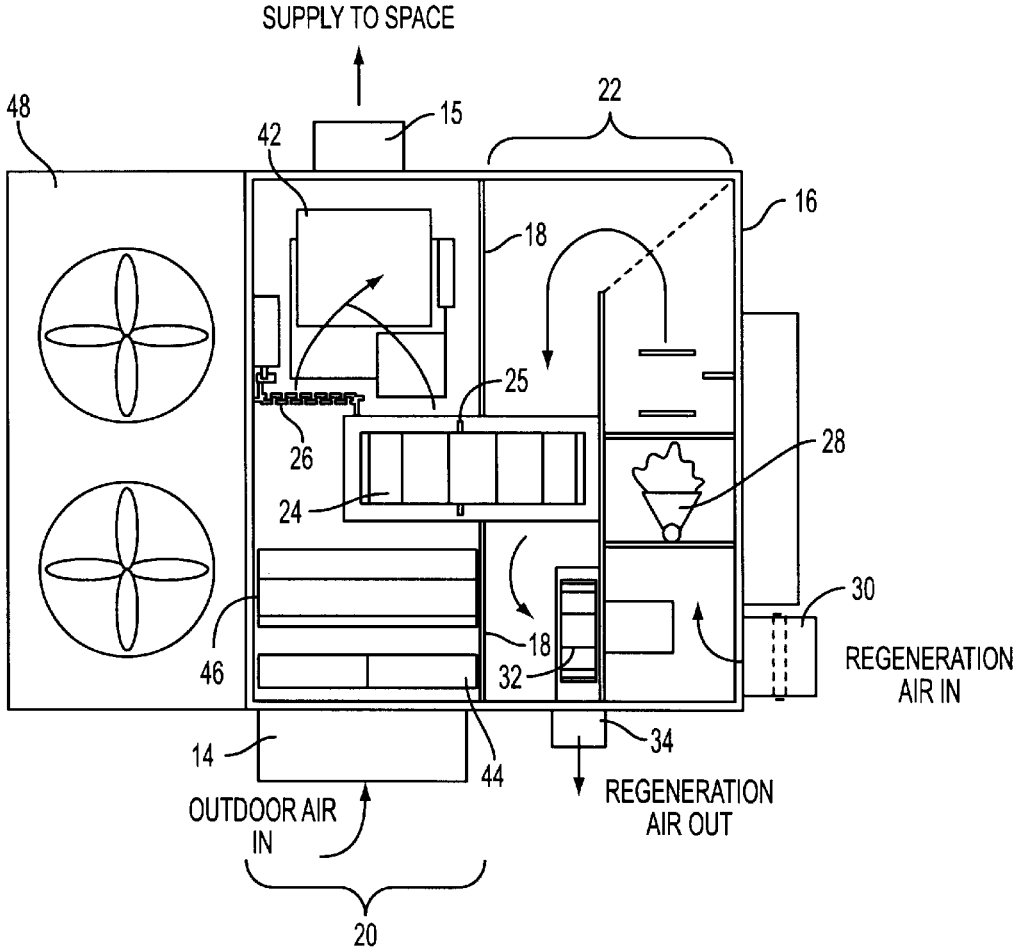
FIG. 3 is a schematic top view of a hybrid air conditioning and dehumidifying apparatus capable of controlling the temperature and humidity of an enclosed space.
Figure 4:
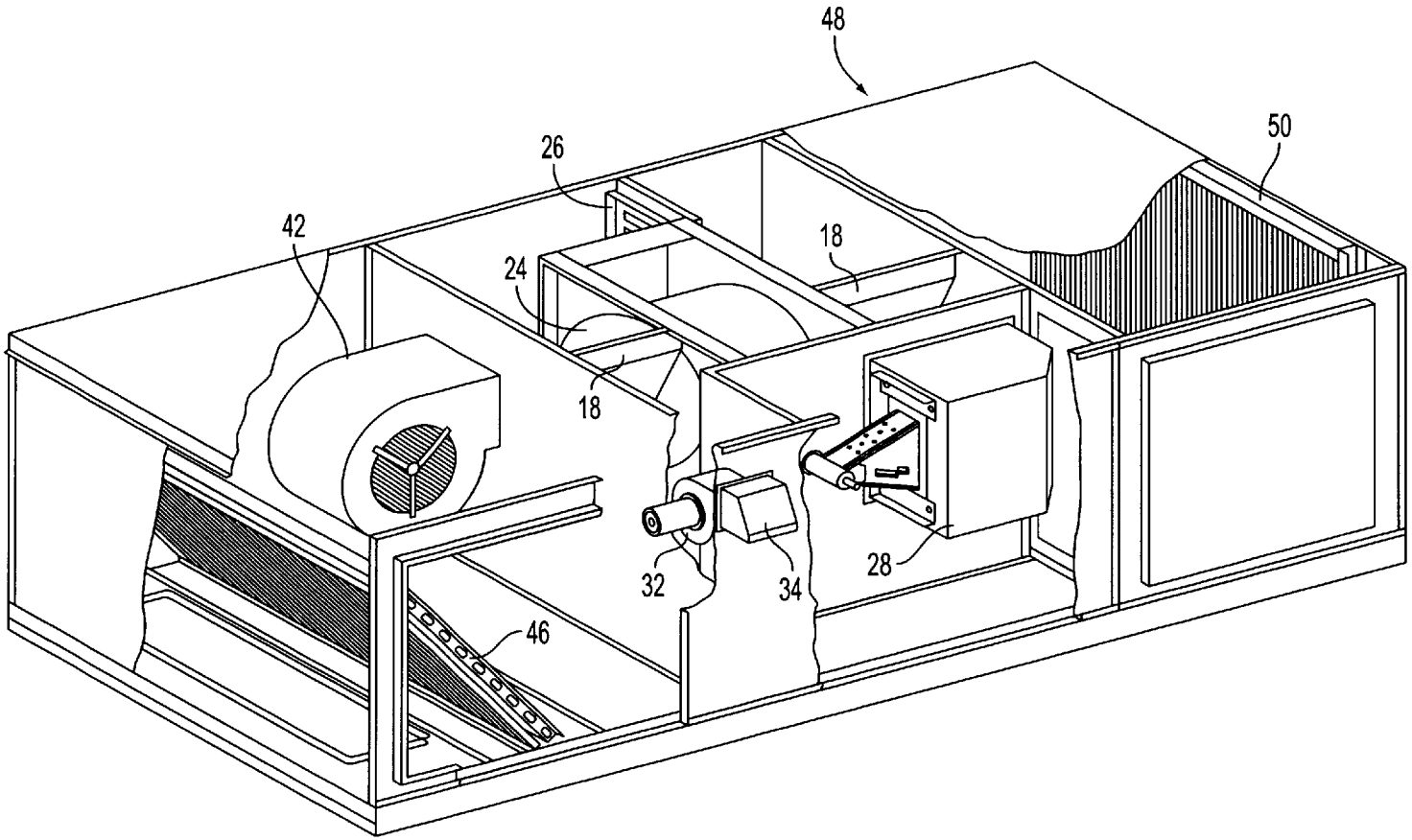
FIG. 4 is a partially broken away perspective view of a hybrid air conditioning and dehumidifying apparatus capable of controlling the temperature and humidity of an enclosed space.

FIGS. 3 and 4 illustrate a hybrid air conditioning and dehumidifying apparatus for controlling the temperature and humidity of an enclosed space. The hybrid unit includes a housing 16 for containing the apparatus. A partition 18 separates the housing into a supply portion 20 for containing a supply air stream and a regeneration portion 22 for containing a regeneration air stream.

The supply portion 20 has an inlet 14 for receiving outdoor air. A supply fan 42 in air flow communication with the supply portion 20 creates the supply air stream. Supply air is drawn through supply inlet 14, preferably through filters 44.

Cooling coil 46 positioned in the supply air stream cools the supply air. Cooling coil 46 may be any of a variety of conventional cooling devices, for example, direct expansion or chilled water coils. In one embodiment, cooling coil 46 is a direct expansion cooling coil, which is part of a conventional refrigeration system. The compressor, condenser and condenser fan components of the refrigeration system are housed in the condensing unit 48.

After passing through the cooling coil 46, the supply air is dehumidified by desiccant wheel 24. Desiccant wheel 24 preferably has an axis of rotation 25 positioned substantially collinear or parallel to the partition 18 such that a portion of the wheel extends into the supply portion 20 and a portion of the wheel extends into the regeneration portion 22. The wheel 24 rotates through the supply air stream and the regeneration air stream to dehumidify the supply air stream. The system preferably includes a mechanism for varying the rotational speed of the desiccant wheel 24 to control the amount of moisture removed from the supply air stream or heat transferred to the supply air stream. The system also preferably includes a bypass damper 26 between the inlet 14 and the outlet 15 of the supply portion 20 for controlling the amount of supply air passing through the desiccant wheel 24 by selectively bypassing the desiccant wheel.

The regeneration portion 22 has an inlet 30 for receiving regeneration air and an outlet 34 for discharging regeneration air. A regeneration fan 32 is in air flow communication with the regeneration portion 22 so as to create a regeneration air stream in the regeneration portion. A heater 28 (e.g., a gas-fired burner and/or any other heat source) heats the regeneration air stream as necessary to regenerate the desiccant wheel 24 as it rotates through the regeneration air stream. The regeneration air may be drawn from ambient air. Alternatively, as discussed above in connection with FIG. 1, the regeneration air can be drawn from the compartment 48 housing the condenser 50 to provide regeneration air that has been preheated by the condenser of the air conditioning system.

As those skilled in the art will appreciate, the various components of the embodiments of the systems shown in FIGS. 1, 2, 3 and 4 can be placed in a variety of different configurations without departing from the scope of the invention. For example, the hybrid system shown in FIG. 3 has the condensing unit 48 on the left side adjacent to the cooling coil 46, whereas in FIG. 4, the condensing unit 48 is on the right side of the system separated from the cooling coil 46. Various other modifications can be made to the illustrated embodiments.

Figure 5:
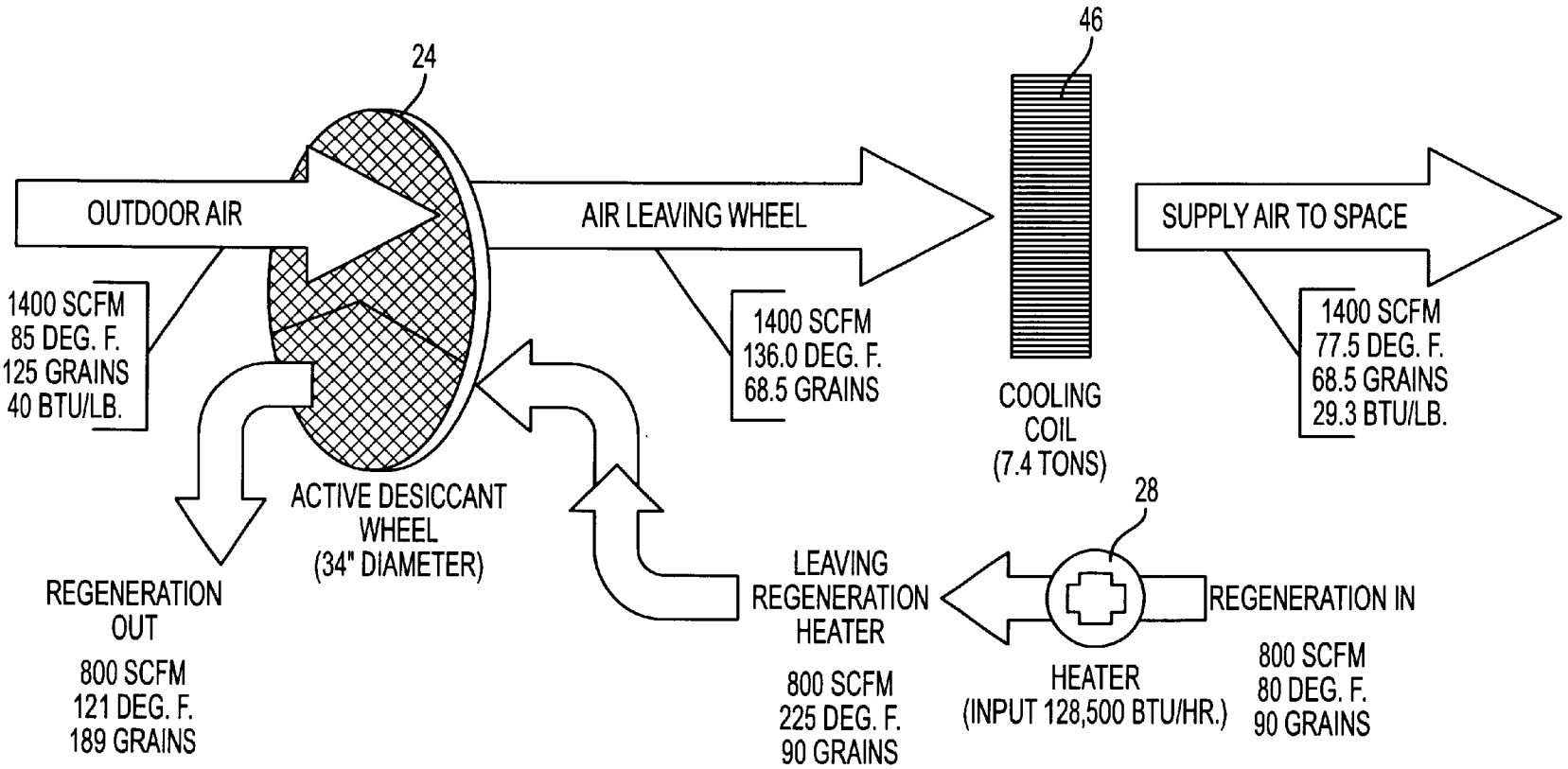
FIG. 5 is a diagram illustrating a sample of the expected performance of a conventional desiccant-based air conditioning and dehumidification system.
Figure 6:
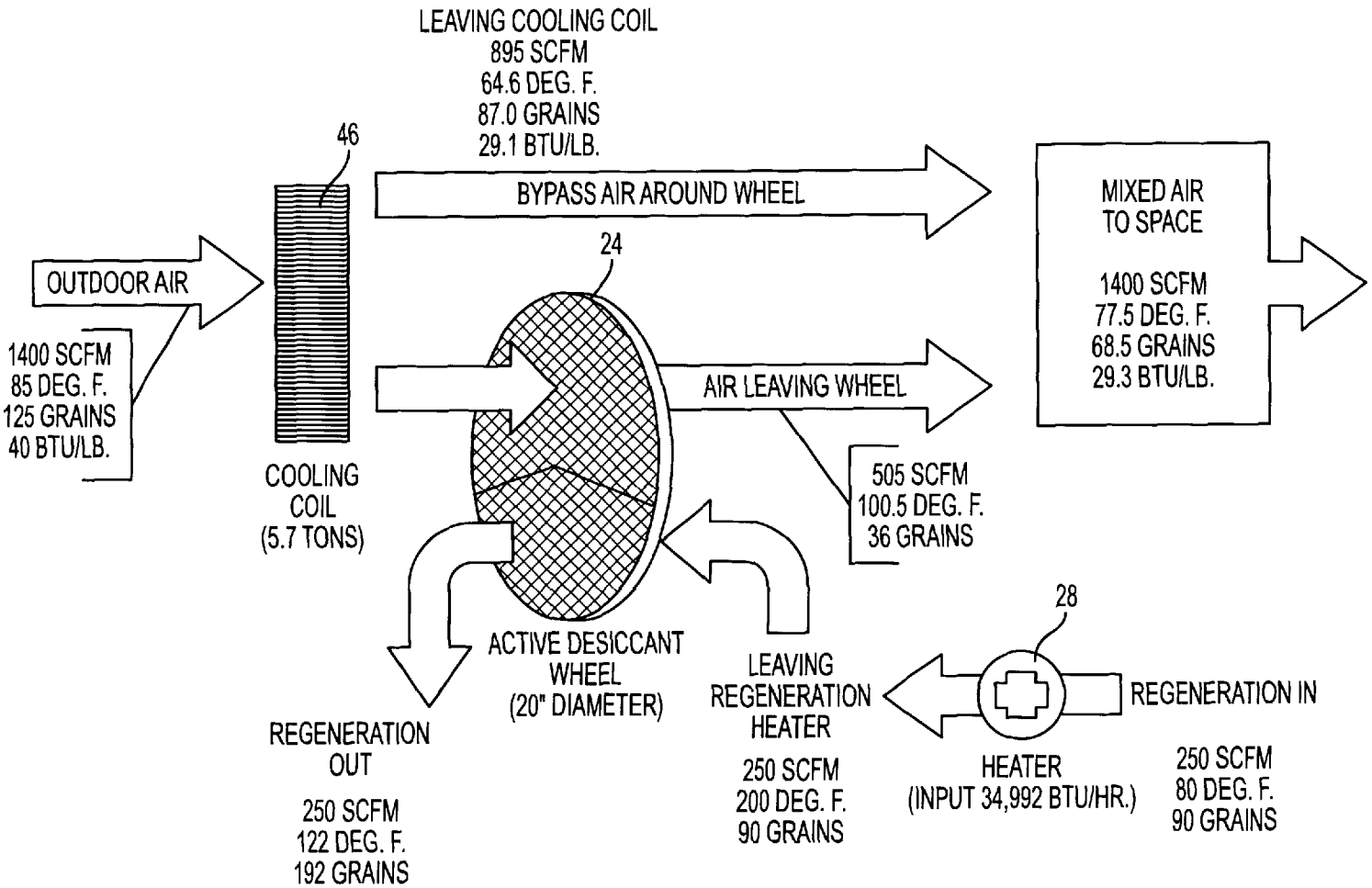
FIG. 6 is a diagram illustrating a sample of the expected performance of an air conditioning and dehumidification system in accordance with the present invention.

FIGS. 5 and 6 illustrate the advantage provided by the positioning of the cooling coil before the desiccant wheel. FIG. 5 illustrates the expected performance of a conventional desiccant preconditioning approach in which the desiccant wheel is positioned before the cooling coil. FIG. 6 illustrates an example of the performance and design of a system having a desiccant wheel downstream of a cooling coil in accordance with the present invention under the same conditions. In both examples, the outdoor air conditions are 85° F. and 125 grains of absolute humidity (68.5% relative humidity). It is desired that each system supply 1400 standard cubic feet per minute of air to the conditioned space at 77.5° F. and 68.5 grains.

To achieve these supply air conditions, the conventional system illustrated in FIG. 5 requires an active desiccant wheel 24 of the type described above having a diameter of approximately 34 inches (4.9 square feet of total net wheel face area after compensating for the outer rim, internal hub cover plate, the spokes and the seals). Assuming that regeneration air is supplied from the outdoors under the temperature and humidity conditions described above, a desiccant wheel of this size, processing this volume of air, would require a 128,500 BTU/hour heater 28 to produced approximately 800 SCFM of regeneration air at 225° F. at an absolute humidity of 90 grains. Under these conditions, the active desiccant wheel 24 would remove approximately 56.5 grains of humidity to achieve the desired humidity level of 68.5 grains of moisture. Air entering the cooling coil 46 would have a temperature of 136° F. and an absolute humidity of 68.5 grains. A cooling coil 46 of approximately 7.4 tons is required to reduce the temperature of the air to the desired supply air condition of 77.5° F. Under these temperature and humidity conditions, the cooling coil 46 provides little or no additional dehumidification.

FIG. 6 illustrates an example of the performance of a system having a cooling coil 46 positioned to process air before the desiccant wheel 24 as described herein. To achieve the desired supply conditions, 1400 SCFM of outdoor air is first passed through a conventional ARI rated 5 ton packaged system providing 5.7 tons of cooling output due to the high temperature and humidity conditions delivered to the cooling coil 46, which cools the air to approximately 64.6° F. In contrast to the conventional approach described above, air entering the cooling coil 46 is near saturation. Because the air enters the cooling coil 46 at a higher relative humidity, the cooling coil 46 is able to significantly dehumidify the air passing through it, removing 38 grains of humidity. Because of the dehumidification provided by the cooling coil 46, the desiccant wheel 24 need only process ⅓ of the air to produce the desired supply air conditions. Accordingly, the size of the wheel 24 can be significantly reduced. In the example shown, the active desiccant wheel required by the system is approximately 20 inches in diameter (compared with 34 inches required with the conventional approach). After subtracting for the rim, hub and spokes, the net square face are of the 20 inch wheel is approximately 1.55 square feet (compared with 4.9 square feet for the wheel of the conventional approach). As a result the size of the wheel installed prior to the cooling coil would have to be 70% larger in diameter and 316% larger in area to perform the same function. Assuming that regeneration air is supplied from the outdoors under the temperature and humidity conditions described above, a desiccant wheel of this size, processing the specified volume of air would require a heater 28 having a capacity of 34,992 BTU/hour (as compared with 128,500 BTU/hour required by the conventional system described above) to produced approximately 250 SCFM of regeneration air at 200° F. and an absolute humidity of 90 grains.

As moisture is cycled by an active desiccant wheel, heat is released. The more heat released, the more the temperature rise across the transfer media. In the conventional configuration presented in FIG. 5, with the active desiccant wheel removing more moisture (greater grain differential) from a much larger air stream, far more heat is inherently added to the outdoor air stream prior to the cooling coil. As a result, the cooling energy provided by the cooling coil positioned after the active desiccant wheel is dedicated to reducing the temperature leaving the active desiccant wheel to the desired 77.5° F. temperature. The cooling coil performs essentially no dehumidification function (i.e., is operated as a dry coil). In the example of a system in accordance with the invention shown in FIG. 5, the cooling coil adds appreciably to the dehumidification function and, since only approximately one third of the airflow passes through the active wheel, far less heat is added to the supply air stream. As importantly, much of the heat added is desirable to bring the delivered air temperature to a room neutral condition.

Thus, it can be seen from the examples illustrated in FIGS. 5 and 6 that the system configured in accordance with the present invention can produce the same desired supply air conditions with a smaller desiccant wheel, smaller capacity cooling coil, and less regeneration heat. As such, the present invention provides a system that can occupy less space, consume less energy, and be manufactured at a lower cost than conventional desiccant-based dehumidification systems. These advantages are significant, particularly for packaged rooftop HVAC applications where size and efficiency are paramount.

System Testing

An add-on ADM and an integrated hybrid system configured in accordance with the invention were designed, produced, instrumented and tested in an air test laboratory at the headquarters of SEMCO Incorporated in Columbia, Mo. As those skilled in the art will appreciate, the systems of the present invention can be configured in a variety of ways. For testing purposes, the add-on ADM module was configured with an active desiccant wheel produced by SEMCO, a direct fired burner, regeneration fan, bypass damper, electrical package and system enclosure as previously described. This module was coupled via a short length (18" of insulated ductwork) with a standard, single stage 5 ton TRANE® VOYAGER™ packaged rooftop unit. The hybrid system was similarly configured except that the active desiccant wheel and other components included in the ADM module were integrated with all of the components included in the standard 5 ton VOYAGER™ packaged rooftop unit to form one homogenous system resembling the standard rooftop in outward appearance (except it was several feet longer) and not requiring the connecting ductwork. The integrated hybrid system incorporated the regeneration energy savings modification to pull the air entering the direct fired burner from the condensing section comprising the TRANE® VOYAGER™ compressor, condensing coil and condenser fan.

The test facility allowed the simulated outdoor air stream entering the packaged HVAC unit and hybrid system to be carefully conditioned and controlled to the desired temperature, humidity and static pressure levels desired for performance monitoring. Both the add on ADM module packaged unit combination and the hybrid system were connected to the test facility and fully instrumented. All instrumentation was connected to a central data acquisition system and monitoring station, allowing real time data to be reviewed and collected. The outdoor air conditions created by the facility's preconditioning system were also controlled and maintained via a direct digital control system (DDC), which was an integral part of the test lab monitoring station.

A duct connection was made directly to the outdoor air intake section of the HVAC unit (in the case of the ADM) and outdoor air intake of the hybrid system. The condensing section ambient air and the regeneration air were drawn from the test lab, which was maintained at approximately 80° F. and 90 grains absolute humidity throughout most of the testing.

As expected, the performance was the same for both the ADM operating in combination with a rooftop HVAC unit and the integrated hybrid system. Tables 1 and 2 below summarize the key performance parameters that were obtained from the testing.

TABLE 1

Summary of test results showing system performance of an ADM with a 5 ton rooftop HVAC unit and hybrid system.

| Outdoor Air Test Conditions | Estimated Cooling Coil Leaving Conditions | Actual Cooling Coil Leaving Conditions | Desiccant Wheel Leaving Conditions | ADM Leaving Conditions | Regeneration Temperature |
|---|---|---|---|---|---|
| Dry Bulb Temperature/Grains of Moisture | | | | | (Deg. F.) |
| 95° F.<br>115 | 66° F.<br>92 | 66.4° F.<br>92 | 103° F.<br>37 | 80° F.<br>72 | 200° F. |
| 85° F.<br>125 | 65.5° F.<br>89 | 64.6° F.<br>87 | 100.5° F.<br>36 | 77.5° F.<br>68 | 200° F. |
| 85° F.<br>110 | 61° F.<br>76 | 63.8° F.<br>84.5 | 99.5° F.<br>31 | 77° F.<br>65 | 200° F. |
| 95° F.<br>100 | 63.5° F.<br>83 | 64.2° F.<br>85 | 101° F.<br>31 | 77° F.<br>65 | 200° F. |
| 75° F.<br>130 | 62.5° F.<br>80 | 63.3° F.<br>83.3 | 100° F.<br>29 | 77° F.<br>64 | 200° F. |
| 85° F.<br>90 | 60° F.<br>73 | 58.4° F.<br>69.7 | 92.5° F.<br>23 | 71° F.<br>53 | 200° F. |
| 75° F.<br>100 | 56° F.<br>63 | 58.5° F.<br>70 | 92° F.<br>23 | 71° F.<br>53 | 200° F. |
| 70° F.<br>90 | 53° F.<br>57 | 54.5° F.<br>60.4 | 88.5° F.<br>20 | 67° F.<br>46 | 200° F. |
| 65° F.<br>85 | 53° F.<br>57 | 52.5° F.<br>56.1 | 82° F.<br>19 | 63° F.<br>43 | 200° F. |
| 65° F.<br>85 | Coil<br>Off | 65° F.<br>85 | 101° F.<br>29 | 78° F.<br>65 | 200° F. |
| 90° F.<br>70 | 57° F.<br>65 | 57.9° F.<br>68.3 | 91° F.<br>22 | 70° F.<br>52 | 200° F. |

TABLE 2

Summary of test results showing latent performance of ADM with a 5 ton rooftop HVAC unit and hybrid system.

| Outdoor Air Conditions | Cooling Coil Leaving Conditions | ADM Leaving Conditions | Latent Load Processed by Rooftop Unit | | Latent Load Processed by ADM with Rooftop Unit or Integrated Hybrid System | |
|---|---|---|---|---|---|---|
| Dry Bulb Temperature/ Grains of Moisture | | | Latent Tons | Delivered Dew Point | Latent Tons | Delivered Dew Point |
| 95° F.<br>115 | 66.4° F.<br>92 | 80° F.<br>72 | 1.8 | 65.6 F. | 3.4 | 58° F. |
| 85° F.<br>125 | 64.6° F.<br>87 | 77.5° F.<br>68 | 3.4 | 63.8° F. | 4.9 | 56° F. |
| 85° F.<br>110 | 63.8° F.<br>85 | 77° F.<br>65 | 2.0 | 63.0° F. | 3.5 | 55.0° F. |
| 95° F.<br>100 | 64.2° F.<br>85 | 77° F.<br>65 | 1.2 | 63.4° F. | 2.7 | 55.0° F. |
| 75° F.<br>130 | 63.3° F.<br>83 | 77° F.<br>64 | 3.7 | 62.5° F. | 5.3 | 54.5° F. |
| 85° F.<br>90 | 58.4° F.<br>70 | 71° F.<br>53 | 1.6 | 57.6° F. | 2.9 | 50.0° F. |
| 75° F.<br>100 | 58.5° F.<br>70 | 71° F.<br>53 | 2.4 | 57.7° F. | 3.7 | 50.0° F. |
| 70° F.<br>90 | 54.5° F.<br>60 | 66° F.<br>46 | 2.3 | 53.7° F. | 3.5 | 46.0° F. |
| 65° F.<br>85 | 52.5° F.<br>56 | 63° F.<br>43 | 2.3 | 51.7° F. | 3.4 | 44.0° F. |
| 65° F.<br>85 | 65° F.<br>85 | 78° F.<br>65 | 0.0 | 64.2° F. | 1.6 | 55.0° F. |
| 90° F.<br>70 | 57.9° F.<br>68 | 70° F.<br>52 | 0.1 | 57.1° F. | 1.5 | 49.0° F. |

Parameters that were optimized in these studies include the bypass air fraction, desiccant wheel speed and cfm/ton processed by the cooling coil. By decreasing the bypass air fraction, drier air could be delivered from the system, but this would result in a slight increase in the delivered air temperature. By decreasing the rotational speed of the desiccant wheel, a cooler delivered air temperature could be obtained at the cost of some dehumidification capacity. By reducing the cfm/ton of air processed by the cooling coil, colder, drier air could be delivered at a reduced airflow capacity. There are many parameters that can be adjusted for these systems. Though such flexibility is an advantage as it relates to control options of the systems of present invention, for testing purposes, parameters must be fixed to allow performance data to be displayed in a concise manner.

To simplify the presentation of the data, the systems were operated as 100% outdoor air systems. For purposes of the test, the standard 5 ton packaged HVAC unit was operated at 285 cfm/ton. Approximately 64% of the supply air was bypassed around the active desiccant wheel. Bypass fraction and regeneration temperature were selected to achieve the delivery of preconditioned outdoor air at a space neutral temperature (between about 68 and 78° F.) and at or below about a 57° F. dew point (70 grains of moisture per pound of dry air). The condenser temperature was maintained at 80° F. during the testing since it was located within the laboratory facility. Regeneration inlet humidity conditions were maintained at 90 grains. A constant regeneration temperature of approximately 200° F. was used to produce the data.

The 5 ton name plate rating of the tested system is associated with the ARI testing criteria, but when a conventional packaged rooftop unit is applied to deliver air to a cooling coil that is warmer and more humid than that used for ARI ratings (for example, 85° F. dry bulb and 76° F. wet bulb as opposed to the ARI 210/240-94 standard condition of 80° F. dry bulb and 67° F. wet bulb), the actual BTUs of cooling capacity delivered by the 5 ton unit is increased by approximately 10%, thereby improving the overall system efficiency and highlighting another advantage associated with the invention described herein.

Table 1 shows a wide range of outdoor air conditions. For each of these outdoor air test conditions, the predicted values for the coil leaving condition (based upon an interpolation of manufacturers' data) in addition to the actual data measured during testing are shown. Good agreement was found between the anticipated coil leaving conditions and those recorded during laboratory testing. In addition to the leaving coil conditions, the conditions leaving the desiccant wheel and those supplied by the system are also presented.

The systems were tested twice at the 65° F., 85 grain outdoor air condition to highlight the ability of the systems to handle outdoor air conditions that are cool yet humid, without the need for operating the cooling coil compressorized section. This highlights another significant advantage offered by the invention. Coils within packaged DX cooling systems can reach a frosting condition when processing high percentages of outdoor air during times when outdoor air is cool and humid because the cool outdoor air conditions allow the cooling cycle to produce far more tons than required. The ability to cycle off the compressor during low-load conditions reduces the risk of potential coil frosting and compressor failure, thereby eliminating the need for costly control mechanisms. It also significantly reduces energy consumption since the compressor can be cycled off a large number of hours per year when the outdoor air is cool yet humid.

The first 65° F./85 grain test point shows the temperature that would be delivered by the ADM/rooftop HVAC combination if both were in operation. Air as dry as 43 grains (a 41° dew point) can be delivered at this condition. The second point shows how the targeted supply air conditions are met without the use of any mechanical cooling, only operating the ADM.

Table 2 provides the test data formulated in a different way to highlight the increased latent capacity made possible by the ADM. As shown, the ADM significantly increased the latent capacity of the conventional 5 ton rooftop HVAC unit. The latent capacity was increased by more than 88% at the latent design condition and more than 125% at part load conditions without increasing the airflow delivered or the amount of conventional cooling capacity utilized.

The ADM can be controlled and operated to deliver a variable dew point with the regeneration input being constant. This control method would be the most basic (least costly) control scheme. It would also most closely resemble how packaged rooftop units are typically controlled in the market today.

Just as the compressor is cycled on and off as the space temperature or supply air temperature conditions are satisfied, the ADM can be configured to simply cycle the regeneration burner to deliver additional dehumidification until a present humidity level is achieved. This control approach is the basis for the data presented in Table 1.

The regeneration burner or other thermal regeneration source can also be modulated and operated to deliver a desired dew point to the space. If the system produces drier air than desired, the amount of heat delivered to the regeneration air stream can be reduced until the desired supply air condition is met.

Upon review of the test data shown in Tables 1 and 2, those skilled in the art will appreciate that the systems configured in accordance with the present invention allowed the conventional rooftop unit to provide dry ventilation at room-neutral temperature in an energy efficient manner. The very dry warm air leaving the desiccant wheel mixes with the cooler, more humid bypass air leaving the evaporator coil to produce the temperature and humidity condition desired.

System Comparison

There are numerous advantages offered by the present invention. Some of those advantages are summarized below through a comparison with the conventional packaged cooling approach and previously marketed active desiccant systems.

Table 3 shows the results of a simple comparison made between the ADM/rooftop packaged HVAC combination and a customized 8.5 ton packaged unit designed to handle 100% outdoor air. The comparison assumes that each system will process 1,400 cfm of outdoor air from a cooling season design conditions of 85° F. and 125 grains to a 56° F. dew point. It also assumes that in order to avoid over-cooling the space, the outdoor air will be reheated to 70° F. prior to its introduction to the space and assumes that 2 degrees of fan heat exists. The energy analyses assume continuous operation and use utility costs of $0.07/kWh for electricity and gas at $4.50/million BTU.

TABLE 3

Comparison of ADM/rooftop HVAC combination with standard customized packaged rooftop unit.

| | Rooftop HVAC with ADM | Custom DX Rooftop HVAC Unit |
|---|---|---|
| Cooling Capacity Required | 5 tons | 8.5 tons |
| Reheat Energy Required (BTU/HR) | 0 | 18,145 |
| Regeneration Energy Required (BTU/HR) | 31,050 | N/A |
| Supply Dew Point Used for Analysis | 56° F. | 56° F. |
| Annual Cooling Energy Cost | $1,360 | $2,315 |
| Approximate Unit Size (H × W × L) | 31" × 46" × 46" | 33.5" × 46.5" × 83" |

As shown, the first obvious advantage is that the tons of mechanical cooling required for the approach of the present invention is only 59% that required by the customized packaged unit. Aside from the obvious advantage of reduced electrical demand and electrical service requirements, this reduces the amount of compressor cycling since the smaller rooftop HVAC unit is fully loaded a much greater percentage of the time. This also minimizes the problem of condensate re-evaporation from the cooling coil discussed previously.

Table 3 also compares the estimated energy consumption for both systems. As shown, this analysis projects the operating cost of the ADM/rooftop HVAC combination to be 41% less than that of the customized rooftop HVAC packaged unit (an HVAC unit having a cooling capacity selected for processing all outdoor air, such as manufactured by DECTRON™ or POOL-PACK™). Designing a packaged system to process 100% outdoor air involves the incorporation of multiple compressors, hot gas bypass capacity controls, a cooling coil that utilizes more rows than are typically applied to standard rooftop units and a reheating coil which can be electric or hot gas energy (hot gas used for the energy analysis shown in Table 3) resulting from the cooling cycle. The projected energy savings could be greater in markets where gas rates are seasonally low during the cooling season, where incentives are offered for gas cooling and where electrical demand charges are high.

The ADM requires a secondary energy input for regeneration that is not required by the customized rooftop HVAC. However, as shown in Table 3, the regeneration energy at peak load conditions is not significantly greater than the energy required for reheat by the customized rooftop HVAC unit. If the regeneration inlet air is pulled from the condensing section housing the compressors, the resulting preheat can easily reduce the regeneration energy consumption shown in Table 3 by more than 20%. More importantly, as the outdoor air loads become less extreme, the amount of regeneration energy required by the ADM can be reduced while maintaining the desired supply air dew point. For the customized packaged unit, the amount of reheat energy remains constant. The customized packaged unit can be designed to use the heat of rejection from the refrigeration circuit to provide "free" reheat. However, a tradeoff in the reduction in the overall cooling efficiency (KW/ton) is required to meet the reheat requirements. Additionally, the reheat temperature delivered from a condensing coil of a refrigeration system is not easily controlled. Another problem is that at part load conditions, only one compressor for example may be required to dehumidify the air to the desired dew point, so there may not be enough energy generated by the cooling cycle to reheat to the desired supply air temperature.

Another significant benefit of the system of the present invention is that when the outdoor air is at cool and humid part load conditions, the ADM allows the HVAC compressor to be cycled off since all of the dehumidification needed can be provided by the desiccant wheel. At these conditions, the customized packaged unit requires the addition of hot gas bypass or multiple staging with sophisticated controls to avoid frosting the cooling coil and potentially damaging the compressor. During cool ambient conditions, excess capacity is provided by the condensing section at the very time that reduced capacity is required at the evaporator coil. Without proper design considerations, this results in unacceptably low suction temperatures (frozen coils). The approach of the present invention resolves this problem.

Other significant control options are provided by the approach of the present invention that are not possible with conventional systems. For example, the system of the present invention has the ability to provide air at much lower dew points than possible with the DX cooling cycle alone. During unoccupied times the 100% outdoor air system can be operated as a recirculated air system, allowing very dry air to be introduced to the space to provide dehumidification without over-cooling the space.

Table 4 provides an analysis summary similar to Table 3, but compares the ADM/packaged rooftop HVAC approach with two previously marketed active desiccant system configurations. In Table 4, the "Rooftop HVAC with ADM" refers to an embodiment of the invention described herein where only approximately 33% of the supply air stream is processed by the active desiccant wheel, and the active desiccant wheel is positioned downstream of the system cooling coil. The approach referred to as "Rooftop HVAC with Active Desiccant Preconditioning" in Table 4 refers to a system where an active desiccant wheel is installed upstream of the system cooling coil, and all of the outdoor air is processed by the active desiccant wheel. The approach referred to as "Rooftop HVAC with DBC Preconditioning" is a traditional desiccant based cooling (DBC) system, which has also been installed upstream of the packaged rooftop system. In addition to the active desiccant wheel, the DBC system includes a sensible only recovery wheel and evaporative cooling section. These components remove much of the heat of adsorption from the outdoor air stream prior to its delivery to the cooling system and preheat the regeneration inlet air stream entering the regeneration heater.

TABLE 4

Comparison of ADM/rooftop HVAC unit combination with previously marketed active desiccant systems for preconditioning outdoor air

| | Rooftop HVAC with ADM | Rooftop HVAC with Active Desiccant Preconditioning | Rooftop HVAC with DBC Preconditioning |
|---|---|---|---|
| Required Cooling Capacity (Tons) | 5 | 7.4 | 2.5 |
| Air Processed by Active Wheel (CFM) | 505 | 1,400 | 1,400 |
| Regeneration Energy Required (BTU/HR) | 31,330 | 128,500 | 61,480 |
| Supply Dew Point Temperature | 56° F. | 56° F. | 56° F. |
| Estimated Annual Cooling Energy Cost | $1,360 | $2,620 | $1,560 |
| Approximate Unit Size (H × W × L) | 31" × 46" × 46" | 52" × 66" × 66" | 52" × 66" × 106" |
| Estimated Relative Manufacturing Cost | 1 | 2.2 | 3 |

The data presented by Table 4 highlights the benefits offered by the approach of the present invention. With respect to performance, the ADM of the present invention provides the desired dehumidification capacity using only 5 tons of mechanical cooling capacity compared to 7.4 tons required by the active desiccant preconditioning approach (installed upstream of the cooling coil). It also utilizes only 24% of the regeneration energy required by the preconditioning approach. The cost of operating a system of the present invention is approximately one half that require by one using the conventional active desiccant preconditioning system. Just as importantly, the size of the system is only 30% of that required by the active desiccant preconditioning system.

The higher moisture loads and regeneration temperatures required by active wheels installed upstream of the cooling coil results in much more heat being added to the air leaving the active desiccant wheel than if it were installed downstream of the cooling coil. As a result, the cooling energy input required to remove the heat added by the active desiccant wheel in the active desiccant preconditioning approach results in far more total cooling capacity being required than for the ADM rooftop HVAC combination of the present invention (48% more in the example shown by Table 4). Also, since more moisture is removed and since far more air is processed, the active desiccant preconditioning approach requires far more regeneration energy than does the ADM rooftop HVAC combination (more than three times as much in the example shown by Table 4).

By adding the sensible only recovery wheel as used by the traditional DBC preconditioning approach the post cooling energy and regeneration energy required by the active desiccant preconditioning approach is greatly reduced, but the increased size and manufacturing cost is approximately 5.5 and 3 times (based upon the example shown in Table 4) that of the ADM rooftop HVAC combination respectively. As shown in Table 4, the ADM rooftop HVAC combination provides the same supply conditions while utilizing less regeneration energy and far less fan horsepower energy (not shown) since the pressure loss associated with the added sensible wheel is eliminated.

Some of these advantages stem from the fact that the system of the present invention can be configured such that only 33% of the outdoor airflow is processed by the active desiccant wheel, while conventional systems typically must process the total amount. The corresponding reduction in the active desiccant wheel diameter results in a much smaller final product. Maintaining a module size compatible with that of the packaged cooling equipment is a significant advantage. It also results in far less fan horsepower being utilized by the combined ADM-rooftop system approach.

Though the examples provided are based upon 100% outdoor air, the supply air from this invention may contain some recirculated air in addition to outdoor air when it is beneficial. For example, if the ADM module is retrofitted to an existing packaged rooftop unit to improve humidity control and only 80% outdoor air is required, then the existing economizer damper arrangement can be set so that 20% recirculated air is delivered to the ADM in addition to the 80% outdoor air. Numerous other instances exist were it is beneficial to process more than 100% outdoor air.

Although the invention has been described with reference to specific embodiments, it will be understood by those skilled in the art that various changes may be made without departing from the spirit or scope of the invention. For instance, the numerous details set forth herein, for example, details relating to the configuration and operation of the presently preferred embodiment of the ADM and hybrid systems, are provided to facilitate the understanding of the invention and are not provided to limit the scope of the invention. Accordingly, the disclosure of embodiments of the invention is intended to be illustrative of the scope of the invention and is not intended to be limiting. It is intended that the scope of the invention shall be limited only to the extent required by the appended claims.

I claim:

1. An apparatus for dehumidifying air supplied to an enclosed space by an air conditioning system, the apparatus comprising:

a) a housing having an interior;

b) a partition separating the interior of the housing into a supply portion for containing a supply air stream and a regeneration portion for containing a regeneration air stream, wherein the supply portion has an inlet for receiving supply air from the air conditioning system and an outlet for supplying air to the enclosed space, and wherein the regeneration portion has an inlet for receiving regeneration air and an outlet for discharging regeneration air;

c) a fan in air flow communication with the regeneration portion for creating the regeneration air stream;

d) a rotatable desiccant wheel positioned such that a portion of the wheel extends into the supply portion and a portion of the wheel extends into the regeneration portion, so that the wheel can rotate through the supply air stream and the regeneration air stream to dehumidify the supply air stream; and e) a heat source capable of heating the regeneration air stream as necessary to regenerate the desiccant wheel as it rotates through the regeneration air stream.

2. The apparatus of claim 1, wherein the heat source is a direct-fired gas burner.

3. The apparatus of claim 1, further comprising a mechanism for modulating the heat source to regulate the temperature of the regeneration air stream.

4. The apparatus of claim 1, further comprising a bypass damper between the inlet and the outlet of the supply portion for controlling the amount of supply air passing through the desiccant wheel by selectively bypassing the desiccant wheel.

5. The apparatus of claim 3, further comprising a mechanism for modulating the bypass damper to regulate the amount of supply air passing through the desiccant wheel.

6. The apparatus of claim 1, wherein the desiccant wheel is sized to handle a fraction of the air flow processed by the air conditioning system.

7. The apparatus of claim 1, wherein the air conditioning system comprises a compartment housing a condenser, the apparatus further comprising a duct or opening connecting the regeneration inlet air to the compartment that houses the condenser, whereby the regeneration inlet air can be preheated by the condenser.

8. The apparatus of claim 1, further comprising a mechanism for varying the rotational speed of the desiccant wheel to control the amount of moisture removed from the supply air stream or heat transferred to the supply air stream.

9. An apparatus for dehumidifying air supplied to an enclosed space by a packaged heating, ventilating, and air conditioning (HVAC) unit, the apparatus comprising:

a) a housing having an interior;

b) a partition separating the interior of the housing into a supply portion for containing a supply air stream and a regeneration portion for containing a regeneration air stream, wherein the supply portion has an inlet for receiving air leaving the HVAC unit and an outlet for supplying air to the enclosed space, and wherein the regeneration portion has an inlet for receiving regeneration air and an outlet for discharging regeneration air;

c) a rotatable desiccant wheel having an axis of rotation positioned such that a portion of the wheel extends into the supply portion and a portion of the wheel extends into the regeneration portion, whereby the wheel can rotate through the supply air stream and the regeneration air stream to dehumidify the supply air stream;

d) a mechanism for varying the rotational speed of the desiccant wheel to control the amount of moisture removed from the supply air stream and/or the amount of heat transferred to the supply air stream;

e) a bypass damper between the inlet and the outlet of the supply portion for controlling the amount of supply air passing through the desiccant wheel by selectively bypassing the desiccant wheel;

f) a fan for creating the regeneration air stream; and g) a gas burner for heating the regeneration air stream as necessary to regenerate the desiccant wheel as it rotates through the regeneration air stream.

10. A hybrid air conditioning and dehumidifying apparatus capable of controlling the temperature and humidity of air supplied to an enclosed space, the apparatus comprising:

a) a housing having an interior;

b) a partition separating the interior of the housing into a supply portion for containing a supply air stream and a regeneration portion for containing a regeneration air stream, wherein the supply portion has an inlet for receiving air and an outlet for supplying air to the enclosed space, and wherein the regeneration portion has an inlet for receiving regeneration air and an outlet for discharging regeneration air;

c) a fan in air flow communication with the regeneration portion for creating the regeneration air stream;

d) a fan in air flow communication with the supply portion for creating the supply air stream;

e) a cooling coil positioned in the supply air stream;

f) a rotatable desiccant wheel positioned downstream of the cooling coil, such that a portion of the wheel extends into the supply portion and a portion of the wheel extends into the regeneration portion, so that the wheel can rotate through the supply air stream and the regeneration air stream to exchange moisture and/or heat between the air streams; and g) a heat source capable of heating the regeneration air stream as necessary to regenerate the desiccant wheel as it rotates through the regeneration air stream.

11. The apparatus of claim 10, wherein the heat source is a direct-fired gas burner.

12. The apparatus of claim 10, further comprising a mechanism for modulating the heat source to regulate the temperature of the regeneration air stream.

13. The apparatus of claim 10, further comprising a bypass damper between the inlet and the outlet of the supply portion for controlling the amount of supply air passing through the desiccant wheel by selectively bypassing the desiccant wheel.

14. The apparatus of claim 13, further comprising a mechanism for modulating the position of the bypass damper to regulate the amount of supply air passing through the desiccant wheel.

15. The apparatus of claim 10, wherein the desiccant wheel is sized to handle a fraction of the air flow processed by the apparatus.

16. The apparatus of claim 10, wherein the apparatus further comprises a compartment housing a condenser, the apparatus further comprising a duct or opening connecting the regeneration inlet air to the compartment that houses the condenser, whereby the regeneration inlet air can be preheated by the condenser.

17. The apparatus of claim 10, further comprising a mechanism for varying the rotational speed of the desiccant wheel to control the amount of moisture removed from the supply air stream or heat transferred to the supply air stream.

18. A hybrid packaged heating, ventilating, and air conditioning (HVAC) and humidity control apparatus capable of controlling the temperature and humidity of air supplied to an enclosed space, the apparatus comprising:

a) a housing having an interior;

b) a partition separating the interior of the housing into a supply portion for containing a supply air stream and a regeneration portion for containing a regeneration air stream, wherein the supply portion has an inlet for receiving air and an outlet for supplying air to the enclosed space, and wherein the regeneration portion has an inlet for receiving regeneration air and an outlet for discharging regeneration air;

c) a regeneration fan in air flow communication with the regeneration portion for creating the regeneration air stream;

d) a supply fan in air flow communication with the supply portion for creating the supply air stream;

e) a cooling coil positioned in the supply air stream;

f) a rotatable desiccant wheel having an axis of rotation positioned such that a portion of the wheel extends into the supply portion and a portion of the wheel extends into the regeneration portion, whereby the wheel can rotate through the supply air stream and the regeneration air stream to dehumidify and/or heat the supply air stream;

g) a mechanism for varying the rotational speed of the desiccant wheel to control the amount of moisture removed from the supply air stream or heat transferred to the supply air stream;

h) a bypass damper between the inlet and the outlet of the supply portion for controlling the amount of supply air passing through the desiccant wheel by selectively bypassing the desiccant wheel; and i) a gas-fired heater capable of heating the regeneration air stream as necessary to regenerate the desiccant wheel as it rotates through the regeneration air stream.

19. A method of controlling the temperature and humidity of an enclosed space, the method comprising the steps of:

a) providing an air conditioning system having a supply outlet;

b) providing an active desiccant module comprising:

1) a housing having an interior;

2) a partition separating the interior of the housing into a supply portion for containing a supply air stream and a regeneration portion for containing a regeneration air stream, wherein the supply portion has an inlet for receiving supply air from the air conditioning system and an outlet for supplying air to the enclosed space, and wherein the regeneration portion has an inlet for receiving regeneration air and an outlet for discharging regeneration air;

3) a fan in air flow communication with the regeneration portion for creating the regeneration air stream;

4) a rotatable desiccant wheel positioned such that a portion of the wheel extends into the supply portion and a portion of the wheel extends into the regeneration portion, so that the wheel can rotate through the supply air stream and the regeneration air stream to dehumidify and/or heat the supply air stream; and 5) a heat source for heating the regeneration air stream as necessary to regenerate the desiccant wheel as it rotates through the regeneration air stream;

c) connecting the supply inlet of the active desiccant module to the supply outlet of the air conditioning system;

d) connecting the supply outlet of the active desiccant module to the enclosed space;

e) cooling and/or dehumidifying the supply air stream by passing it through the air conditioning system;

f) dehumidifying and/or heating the supply air after it has passed through the air conditioning system by passing it through the active desiccant module while rotating the wheel through the supply air stream and the regeneration air stream to exchange moisture and/or heat between the air streams; and g) supplying the supply air leaving the active desiccant module to the enclosed space.

20. The method of claim 19, wherein the active desiccant module further comprises a bypass damper between the inlet and the outlet of the supply portion, and wherein the step of dehumidifying the supply air stream further comprises the step of controlling the level of dehumidification by selectively bypassing the desiccant wheel.

21. The method of claim 19, wherein the air conditioning system comprises a compartment housing a condenser, the method further comprising the step of preheating the regeneration inlet air by drawing it from the compartment that houses the condenser.

22. The method of claim 19, further comprising the step of varying the rotational speed of the desiccant wheel to control the amount of moisture removed from the supply air stream and/or the amount of heat transferred to the supply air stream.

23. A method of controlling the temperature and humidity of an enclosed space, the method comprising the steps of:

a) providing a packaged heating, ventilating, and air conditioning (HVAC) unit having a supply outlet;

b) providing an active desiccant module comprising:

1) a housing having an interior;

2) a partition separating the interior of the housing into a supply portion for containing a supply air stream and a regeneration portion for containing a regeneration air stream, wherein the supply portion has an inlet for receiving air leaving the HVAC unit and an outlet for supplying air to the enclosed space, and wherein the regeneration portion has an inlet for receiving regeneration air and an outlet for discharging regeneration air;

3) a rotatable desiccant wheel having an axis of rotation positioned such that a portion of the wheel extends into the supply portion and a portion of the wheel extends into the regeneration portion, whereby the wheel can rotate through the supply air stream and the regeneration air stream to exchange moisture and/or heat between the air streams;

4) a mechanism for varying the rotational speed of the desiccant wheel;

5) a bypass damper between the inlet and the outlet of the supply portion for controlling the amount of supply air passing through the desiccant wheel;

6) a fan for creating the regeneration air stream; and 7) a gas burner for heating the regeneration air stream as necessary to regenerate the desiccant wheel as it rotates through the regeneration air stream;

c) connecting the supply inlet of the active desiccant module to the supply outlet of the HVAC unit;

d) connecting the supply outlet of the active desiccant module to the enclosed space;

e) passing the supply air stream through the HVAC unit;

f) dehumidifying and/or heating the supply air after it has passed through the HVAC unit by rotating the wheel through the supply air stream and the regeneration air stream to exchange moisture and/or heat between the air streams;

g) controlling the dehumidification of the supply air by selectively bypassing the desiccant wheel;

h) varying the rotational speed of the desiccant wheel to control the amount of moisture removed from the supply air stream and/or heat transferred to the supply air stream, and i) supplying the air leaving the active desiccant module to the enclosed space.

24. A method of controlling the temperature and humidity of an enclosed space, the method comprising the steps of:

a) providing a hybrid air conditioning and dehumidifying apparatus comprising:
1) a housing having an interior;
2) a partition separating the interior of the housing into a supply portion for containing a supply air stream and a regeneration portion for containing a regeneration air stream, wherein the supply portion has an inlet for receiving air and an outlet for supplying air to the enclosed space, and wherein the regeneration portion has an inlet for receiving regeneration air and an outlet for discharging regeneration air;
3) a fan in air flow communication with the regeneration portion for creating the regeneration air stream;
4) a fan in air flow communication with the supply portion for creating the supply air stream;
5) a cooling coil positioned in the supply air stream;
6) a rotatable desiccant wheel positioned downstream of the cooling coil, such that a portion of the wheel extends into the supply portion and a portion of the wheel extends into the regeneration portion, so that the wheel can rotate through the supply air stream and the regeneration air stream to exchange moisture and/or heat between the air streams; and
7) a heat source capable of heating the regeneration air stream as necessary to regenerate the desiccant wheel as it rotates through the regeneration air stream;

b) cooling and/or dehumidifying the supply air stream by passing it through the cooling coil;

c) dehumidifying and/or heating the supply air after it has passed through the cooling coil by rotating the desiccant wheel through the supply air stream and the regeneration air stream to exchange moisture and/or heat between the air streams; and d) supplying the supply air leaving the active desiccant module to the enclosed space.

25. The method of claim 24, wherein the apparatus further comprises a bypass damper between the inlet and the outlet of the supply portion, and wherein the step of dehumidifying the supply air stream further comprises the step of controlling the level of dehumidification by selectively bypassing the desiccant wheel.

26. The method of claim 24, further comprising the step of varying the rotational speed of the desiccant wheel to control the amount of moisture removed from the supply air stream and/or the amount heat transferred to the supply air stream.

27. The method of claim 24, wherein the hybrid air conditioning and dehumidifying apparatus further comprises a compartment housing a condenser, the method further comprising the step of preheating the regeneration inlet air by drawing it from the compartment that houses the condenser.

28. A method of controlling the temperature and humidity of an enclosed space, the method comprising the steps of:

a) providing a hybrid heating, ventilating, and air conditioning (HVAC) and dehumidifying apparatus comprising:
1) a housing having an interior;
2) a partition separating the interior of the housing into a supply portion for containing a supply air stream and a regeneration portion for containing a regeneration air stream, wherein the supply portion has an inlet for receiving air and an outlet for supplying air to the enclosed space, and wherein the regeneration portion has an inlet for receiving regeneration air and an outlet for discharging regeneration air;
3) a regeneration fan in air flow communication with the regeneration portion for creating the regeneration air stream;
4) a supply fan in air flow communication with the supply portion for creating the supply air stream;
5) a cooling coil positioned in the supply air stream;
6) a rotatable desiccant wheel having an axis of rotation positioned substantially collinear or parallel to the partition such that a portion of the wheel extends into the supply portion and a portion of the wheel extends into the regeneration portion, whereby the wheel can rotate through the supply air stream and the regeneration air stream to dehumidify the supply air stream;
7) a mechanism for rotating the desiccant wheel at a plurality of speeds;
8) a bypass damper between the inlet and the outlet of the supply portion for controlling the amount of supply air passing through the desiccant wheel by selectively bypassing the desiccant wheel; and
9) a gas-fired heater capable of heating the regeneration air stream as necessary to regenerate the desiccant wheel as it rotates through the regeneration air stream;

b) cooling and/or dehumidifying the supply air stream by passing it through the cooling coil;

c) dehumidifying and/or heating the supply air after it has passed through the cooling coil by passing it through the active desiccant module while rotating the wheel through the supply air stream and the regeneration air stream to exchange moisture and/or heat between the air streams; and d) controlling the level of dehumidification by selectively bypassing the desiccant wheel;

e) controlling the amount of moisture and/or heat transferred to the supply air by adjusting the rotational speed of the desiccant wheel; and f) supplying the supply air leaving the active desiccant module to the enclosed space.

* * * * *